US007324656B2

(12) United States Patent
Iwayama et al.

(10) Patent No.: US 7,324,656 B2
(45) Date of Patent: Jan. 29, 2008

(54) WIDE DISPERSION SPEAKER SYSTEM AND COVER MOUNTING STRUCTURE FOR INSTRUMENT DIRECTLY MOUNTED TO FLAT PORTION

(75) Inventors: Ken Iwayama, Nishinomiya (JP); Takashi Nishino, Jakarta Timur (IN)

(73) Assignee: TOA Corporation, Kobe-shi, Hyogo (JP)

( * ) Notice: Subject to any disclaimer, the term of this patent is extended or adjusted under 35 U.S.C. 154(b) by 0 days.

(21) Appl. No.: 10/535,715

(22) PCT Filed: Nov. 20, 2003

(86) PCT No.: PCT/JP03/14779

§ 371 (c)(1),
(2), (4) Date: Dec. 19, 2005

(87) PCT Pub. No.: WO2004/047483

PCT Pub. Date: Jun. 3, 2004

(65) Prior Publication Data

US 2006/0159299 A1 Jul. 20, 2006

(30) Foreign Application Priority Data

Nov. 20, 2002 (JP) ..... 2002-337104
Dec. 9, 2002 (JP) ..... 2002-356719

(51) Int. Cl.
*H04R 25/00* (2006.01)

(52) U.S. Cl. ..... 381/386; 381/391; 381/189

(58) Field of Classification Search ..... 381/87, 381/337, 339, 340, 341, 342, 343, 346, 347, 381/160, 162, 165, 386, 391, 189; 181/148, 181/155–156, 175, 184–185
See application file for complete search history.

(56) References Cited

U.S. PATENT DOCUMENTS 1,884,724 A * 10/1932 Keller ..... 181/148
3,909,530 A * 9/1975 Gosswiller ..... 381/342

FOREIGN PATENT DOCUMENTS

| | | |
|---|---|---|
| JP | 51-049022 | 4/1976 |
| JP | 5149022 | 6/1993 |
| JP | 2001-216830 | 8/2001 |

OTHER PUBLICATIONS

International Search Report for International Applicaiton No. PCT/JP03/14779 by the Japanese Patent Office dated Jan. 20, 2004 (1 page).

* cited by examiner

*Primary Examiner*—Huyen Le
(74) *Attorney, Agent, or Firm*—Marshall, Gerstein & Borun

(57) ABSTRACT

A wide dispersion speaker system 1 comprises a cone type speaker unit 2, and a restricting element 10A. The restricting element 10A is provided with a center hole 11 at a center section thereof, and a peripheral hole 12 located outward relative to the center hole 11. The restricting element 10A has an annular sound travel inhibiting portion 19 positioned radially outward relative to the center hole 11 and radially inward relative to the peripheral hole 12. An outer end in a radial direction of the sound travel inhibiting portion 19 is positioned at a substantially middle point between an outer end in the radial direction of the center hole 11 and an outer end in the radial direction of the peripheral hole 12 or positioned radially outward relative to the substantially middle point.

23 Claims, 28 Drawing Sheets

WIDE DISPERSION SPEAKER SYSTEM AND COVER MOUNTING STRUCTURE FOR INSTRUMENT DIRECTLY MOUNTED TO FLAT PORTION

The present application claims the benefit of priority of International Patent Application No. PCT/JP2003/014770 filed on Nov. 20, 2003, which application claims priority of Japanese Patent Application No. 2002-337104 filed Nov. 20, 2002 and Japanese Patent Application No. 2002-356719 filed Dec. 9, 2002. The entire text of the priority application is incorporated herein by reference in its entirety.

TECHNICAL FILED

The present invention relates to a wide dispersion speaker system capable of widening directivity.

The present invention also relates to a structure by which a cover is mounted to an instrument body directly mounted to a flat portion and, more particularly to a cover mounting structure for an instrument directly mounted to a flat portion, which is capable of preventing disengagement of a cover.

BACKGROUND ART

Conventionally, attempts have been made to widen directivity of speaker systems (see for example, Japanese Utility Model Application Publication No. Hei. 4-59696 (page 1, FIG. 1)). FIG. 26 is a longitudinal sectional view of a conventional wide dispersion speaker system 201.

In this speaker system 201, a panel 210 having an opening 211 is disposed forward relative to a diaphragm. The opening 211 is formed concentrically with a speaker unit 202. A diffuser 204 of a droplet shape is disposed forward relative to the opening 211.

The opening 211 of the panel 210 has an area smaller than that of the diaphragm of the speaker unit 202. In other words, an apparent opening area of the diaphragm of the speaker unit 202 is restricted by the panel 210. Such a restricting element (panel 210 having the opening 211) is capable of widening directivity in contrast to a construction in which only the diffuser 204 is disposed forward relative to the diaphragm.

There has been disclosed a speaker system comprising a panel having a center opening and being entirely provided with a number of circular holes is disposed forward relative to a diaphragm (see for example, Japanese Patent Application Publication No. Hei. 8-331684 (page 2, FIG. 1). Because of a number of circular holes formed over the entire panel, the panel does not substantially produce a restricting effect, and as a result, sufficient directivity is not obtained.

While the speaker system 201 using the panel 210 as a restricting member is illustrated in FIG. 26, directivity is in some cases not sufficiently widen with this structure. Especially in medium and high sound areas, desired directivity is in some cases not obtained.

In order to widen the directivity in the medium and high sound ranges without substantial change in the structure of the speaker system 201 having the structure in FIG. 26, the opening 211 of the panel 210 may be configured to have a smaller diameter. However, it may be anticipated that if the area of the opening 211 is reduced excessively, i.e., the apparent opening area of the diaphragm is restricted excessively, then an acoustic energy generated in the speaker unit 202 is not sufficiently radiated to outside. This imposes a limitation on reduction of the area of the opening 211 of the panel 210 to widen the directivity.

Meanwhile, a cover is mounted to an instrument body directly mounted to a flat portion. By way of example, in a ceiling-embedded speaker system directly mounted to a ceiling face, a speaker system body is mounted to an opening of a ceiling wall, and a cover is mounted from forward (below) to cover a front face of the speaker system body.

FIG. 27 is a conventional cover mounting structure. A ceiling wall 370 has a circular opening, and a speaker system body 310 having a speaker unit 311 is mounted into the opening. The speaker system body 310 mainly includes the speaker unit 311 and a mounting element 315. The mounting element 315 is provided with a circular hole (not shown) at a center section thereof. A diaphragm of the speaker unit 311 mounted to a rear face of the mounting element 315 is configured to be visible through the circular hole. The mounting element 315 with the speaker unit 311 mounted to the rear face thereof is secured to the ceiling wall 370, thereby allowing the speaker system body 310 to be directly and securely mounted to the ceiling.

A sound-transmissible cover 340 is mounted to the mounting element 315 so as to cover a front face of the speaker system body 310.

A plurality of body engagement portions 320 are formed at positions of a peripheral edge portion of the mounting element 315. In addition, cover engagement portions 350 are formed at positions of a peripheral edge portion of the cover 340 so as to correspond to the body engagement portions 320.

When the cover 340 is mounted to the speaker system body 310, the cover 340 is first fitted to the speaker system body 310 such that the body engagement portions 320 are close to the cover engagement portions 350, and then, the cover 340 is rotated. This causes the cover engagement portions 350 to be moved to be positioned on the body engagement portions 320, and engagement between them (body side engagement portions 320 and the cover engagement portions 350) is accomplished.

FIGS. 28(*a*) to 28(*c*) show a state in which the body engagement portion 320 and the cover engagement portion 350 are going to engage with each other step by step. FIG. 28(*a*) shows a state in which engagement is going to start. FIG. 28(*b*) shows a state before engagement is accomplished. FIG. 28(*c*) shows a state in which engagement is accomplished. When the state of FIG. 28(*b*) transitions to the state of FIG. 28(*c*), a protrusion 353 of the cover engagement portion 350 moves over a protrusion 327 of the body engagement portion 320. When the engagement is accomplished in the state (c), engagement between them (the body engagement portion 320 and the cover engagement portion 350) is not released unless a large rotational force is applied to the cover 340. Therefore, in a normal use condition of the cell-embedded speaker system, the cover 340 does not disengage from speaker system body 310.

When an operator is going to mount the cover 340 to the speaker system body 310, the operator may leave them in the state of FIG. 28(*b*). This is because, for example, when an upper end of the cover 340 is in contact with a ceiling face, the operator must apply a large force to the cover 340 to cause the state of FIG. 28(*a*) to transition to the state of FIG. 28(*b*), and the cover 340 is firmly secured even in the state of FIG. 28(*b*). So, the operator may assume mistakenly that the engagement between the engagement portions (the body engagement portion 320 and the cover engagement portion 350) is accomplished even in the state of FIG. 28(*b*), and may finish an operation in the state of FIG. 28(*b*).

If the cover 340 and the speaker system body 310 are left in the state of FIG. 28(*b*), the cover 340 may disengage from the speaker system body 310. In particular, when the speaker unit 311 is driven, the speaker system body 310 or the cover 340 vibrates, and the cover 340 gradually rotates in a direction to disengage from the speaker system body 310. Finally, the cover 340 may fall off from the speaker system body 310.

DISCLOSURE OF THE INVENTION

An object of the present invention is to provide a wide dispersion speaker system capable of widening directivity.

In order to achieve the above described object, a wide dispersion speaker system of the present invention comprises a cone type speaker unit; and a restricting element, wherein the cone type speaker unit has a diaphragm, the restricting element is configured to cover the diaphragm from forward, the restricting element is provided with a center hole and a peripheral hole, the center hole is positioned forward relative to a center section of the diaphragm, the peripheral hole is positioned radially outward relative to the center hole, a sum of an area of the center hole and an area of the peripheral hole is smaller than an area of the diaphragm, the restricting element has an annular sound travel inhibiting portion positioned radially outward relative to the center hole and radially inward relative to the peripheral hole, and an outer end in a radial direction of the sound travel inhibiting portion is positioned at a substantially middle point between an outer end in the radial direction of the center hole and an outer end in the radial direction of the peripheral hole, or positioned radially outward relative to the substantially middle point.

In accordance with such a structure, an acoustic wave travels through the center hole and the peripheral hole. The directivity of the wide dispersion speaker system results from interference between the acoustic wave from the center hole and the acoustic wave from the peripheral hole. Assuming that the acoustic wave from the center hole and the acoustic wave from the peripheral hole are individually extracted, the acoustic wave from the center hole forms a relatively wide directivity and the acoustic wave from the peripheral hole forms a relatively narrow directivity. A phase difference is generated between the acoustic wave from the center hole and the acoustic wave from the peripheral hole, and interference between them is noticeable especially in a direct-front range. As a result, a sound pressure level is lowered relatively in the direct-front range. That is, the degree to which the sound pressure levels in the direct-front range are added decreases, and as a result, the directivity of the wide dispersion speaker system is widened in specific frequency range.

In the wide dispersion speaker system, the outer end in the radial direction of the peripheral hole may be positioned in the vicinity of a peripheral edge portion of the diaphragm in the radial direction. When the diaphragm has an edge portion at a peripheral edge of a conical portion, the outer end in the radial direction of the peripheral hole may be positioned in the vicinity of the peripheral edge portion of the conical portion or in the vicinity of the edge portion in the radial direction. When the diaphragm is edgeless, the outer end in the radial direction of the peripheral hole may be positioned in the vicinity of the peripheral edge portion of the conical portion. By providing the peripheral hole at an outermost end in the radial direction, the directivity formed by the acoustic wave from the peripheral hole becomes narrower, and the phase difference with respect to the acoustic wave from the center hole becomes larger. As a result, the directivity of the wide dispersion speaker system is widened.

In the wide dispersion speaker system, the peripheral hole may be formed to surround an entire periphery of the center hole. Or, the peripheral hole may be one of a plurality of peripheral holes which are configured to be distributed to surround the entire periphery of the center hole. In accordance with such a structure, it is anticipated that the directivity is widened uniformly entirely in a circumferential direction.

It is preferable that in the wide dispersion speaker system, the peripheral hole may be formed to surround the center hole in an angular range of not less than 180 degrees around a center axis of the cone type speaker unit. Or, it is preferable that the peripheral hole may be one of a plurality of peripheral holes which are configured to be distributed to surround the center hole in an angular range of not less than 180 degrees around a center axis of the cone type speaker unit.

In the wide dispersion speaker system, the peripheral hole may be configured not to be formed in an angular range of not less than 45 degrees around the center axis of the cone type speaker unit.

In the wide dispersion speaker system, the peripheral hole may be a slit hole extending in the radial direction. Since the peripheral hole extends radially, rigidity of the restricting element is not substantially reduced regardless of a number of peripheral holes. Therefore, a total area of the peripheral holes may be set relatively freely, and a sound pressure level from the peripheral hole is adjustable. This can solve problems that the level of the acoustic wave from the peripheral hole is insufficient or otherwise the level of the acoustic wave becomes too high up to a state in which the directivity of the acoustic wave from the peripheral hole becomes predominant, and thus a desired directivity is not obtained.

In the wide dispersion speaker system, the peripheral hole may have a slit width smaller than a depth of the peripheral hole. In an extremely high frequency, if the slit width is set smaller than the depth of the hole, then the peripheral hole produces a resistance to the acoustic wave, so that the level of the acoustic wave from the center hole can be made sufficiently lower than the level of the acoustic wave from the center hole. Therefore, it may be assumed that in the extremely high frequency, only the acoustic wave level from the center hole is output, and disorder of the directivity is alleviated.

In the wide dispersion speaker system, the peripheral hole may be disposed non-symmetrically with respect to a center axis of the cone type speaker unit. When the peripheral hole is disposed symmetrically with respect to the center axis, a sharp dip may occur because of a sound pressure level frequency characteristic of the wide dispersion speaker system in the direct-front range. By disposing the peripheral hole non-symmetrically with respect to the center axis, such a sharp dip is alleviated.

In the wide dispersion speaker system, a diffuser may be mounted forward relative to the center hole. There is a limit to reduction of the center hole to widen the directivity, but it is anticipated that the directivity can be widened especially in the high frequency band by providing the diffuser.

Another aspect of the present invention is directed to providing a cover mounting structure for an instrument directly mounted to a flat portion which is capable of preventing disengagement of the cover.

In order to achieve this object, a cover mounting structure for an instrument directly mounted to a flat portion of the present invention, comprises an instrument body directly mounted to the flat portion; and a cover mounted to the instrument body so as to cover a front face of the instrument body, wherein the instrument body is provided with a body engagement portion at a peripheral edge portion of a substantially circular shape, the cover is provided with a cover engagement portion at a position corresponding to the body engagement portion, the body engagement portion has a rear face extending in a circumferential direction, a first protrusion formed at a base end in a direction in which the rear face extends and configured to protrude rearward further than the rear face, and a second protrusion formed at a tip end in a direction in which the rear face extends and configured to protrude rearward further than the rear face, the cover engagement portion has a front face extending in the circumferential direction, and a third protrusion formed at a tip end in a direction in which the front face extends and configured to protrude forward further than the front face, and the body engagement portion is provided in the instrument body and the cover engagement portion is provided in the cover to allow the front face of the cover engagement portion to be positioned rearward relative to the rear face of the body engagement portion, with the cover mounted to cover the instrument body from forward.

In accordance with such a structure, when the cover engagement portion is moved to and positioned on the body engagement portion and the third protrusion has moved over the first protrusion and the second protrusion, engagement is accomplished. If the operation for mounting the cover to the instrument body finishes under the condition in which the third protrusion has moved over the first protrusion but has not moved over the second protrusion, the cover does not engage from the instrument body unless the third protrusion moves over the first protrusion in a reverse direction. This will not occur unless a substantial rotational force is applied to the cover. As a result, the cover does not easily disengage from the instrument body if the operation for mounting the cover to the instrument body finishes under the condition in which the third protrusion has moved over the first protrusion but has not moved over the second protrusion.

In order to achieve the above object, another cover mounting structure for an instrument directly mounted to a flat portion, of the present invention, comprises an instrument body directly mounted to the flat portion; and a cover mounted to the instrument body so as to cover a front face of the instrument body, wherein the instrument body is provided with a body engagement portion at a peripheral portion of a substantially circular shape, the cover is provided with a cover engagement portion at a position corresponding to the body engagement portion, the cover engagement portion has a front face extending in a circumferential direction, a first protrusion formed at a tip end in a direction in which the front face extends and configured to protrude forward further than the front face, and a second protrusion formed at a base end in a direction in which the front face extends and configured to protrude forward from the front face, the body engagement portion has a rear face extending in the circumferential direction, and a third protrusion formed at a base end in a direction in which the rear face extends and configured to protrude rearward further than the rear face, and the body engagement portion is provided in the instrument body and the cover engagement portion is provided in the cover to allow the front face of the cover engagement portion to be positioned rearward relative to the rear face of the body engagement portion, with the cover mounted to cover the instrument body from forward.

In accordance with such a structure, when the cover engagement portion is moved to and positioned on the body engagement portion, and the first protrusion and the second protrusion have moved over the third protrusion, engagement is accomplished. If the operation for mounting the cover to the instrument body finishes under the condition in which the first protrusion has moved over the third protrusion but the second protrusion has not moved over the third protrusion, the cover does not engage from the instrument body unless the first protrusion moves over the third protrusion in a reverse direction. This will not happen unless a substantial rotational force is applied to the cover. As a result, the cover does not easily disengage from the instrument body if the operation for mounting the cover to the instrument body finishes under the condition in which the first protrusion has moved over the third protrusion but the second protrusion has not moved over the third protrusion.

In the cover mounting structure for an instrument directly mounted to a flat portion, the body engagement portion may be one of a plurality of body engagement portions provided in the instrument body and the cover engagement portion may be one of a plurality of cover engagement portions provided in the cover such that the plurality of body engagement portions are respectively positioned to correspond to the plurality of cover engagement portions.

Since engagement is made at plural positions in such a structure, the cover is less likely to disengage from the instrument body.

In the cover mounting structure for an instrument directly mounted to a flat portion, a part or all of the first protrusion, the second protrusion, and the third protrusion may be flexible forward and rearward.

In accordance with such a structure, a protrusion can move over another protrusion in an operation for engagement without a large rotational force. This facilitates smooth mounting operation.

In the cover mounting structure for an instrument directly mounted to a flat portion, the instrument directly mounted to the flat portion may be a ceiling-embedded speaker system, the instrument body may have a speaker unit, and the cover may be a sound-transmissible cover.

Since the ceiling-embedded speaker system is susceptible to vibration from the speaker unit, and therefore, is desirably mounted to the instrument body of the cover (speaker system body) in a stable condition, such a structure is especially advantageous.

These objects as well as other objects, features and advantages of the invention will become more apparent to those skilled in the art from the following description with reference to the accompanying drawings.

BEST MODE FOR CARRYING OUT THE INVENTION

Hereinafter, embodiments of the present invention will be described with reference to the drawings.

Embodiment 1

A first embodiment of the present invention will be described with reference to the drawings. A basic structure of a wide dispersion speaker system 1 according to an embodiment of the present invention will be described with reference to FIGS. 1 to 5.

Figure 1:
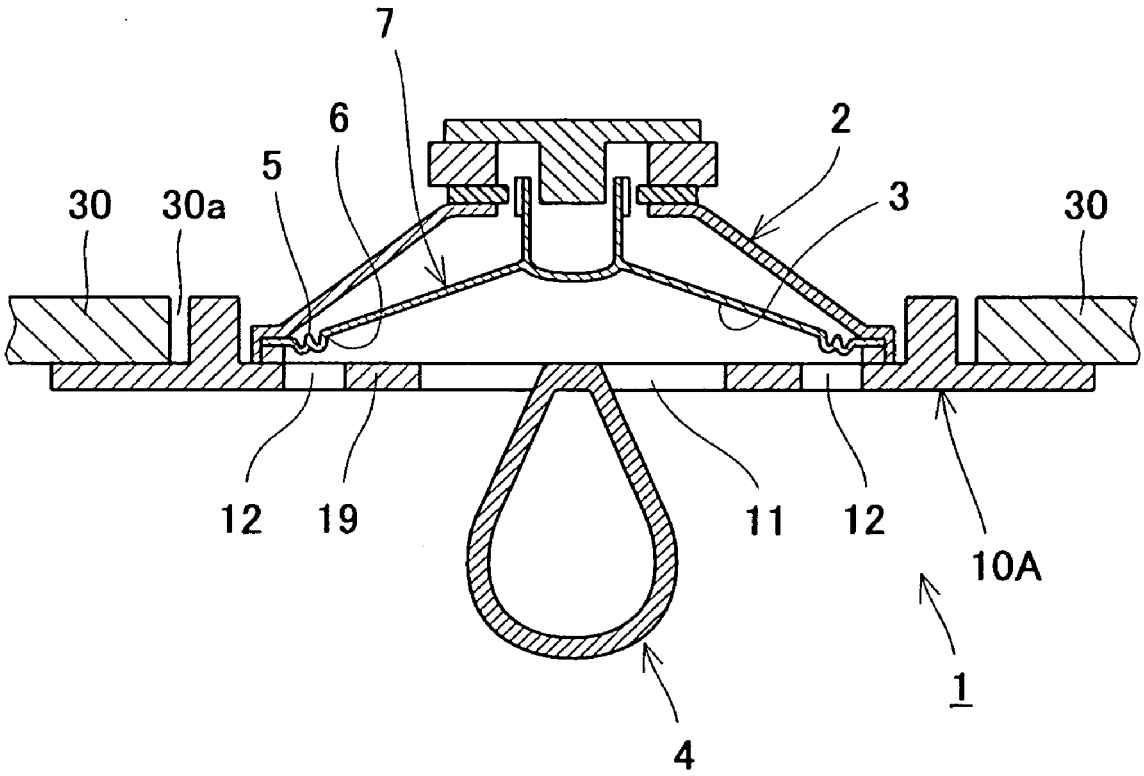
FIG. 1 is a longitudinal sectional view of a wide dispersion speaker system mounted to a ceiling wall.
Figure 2:
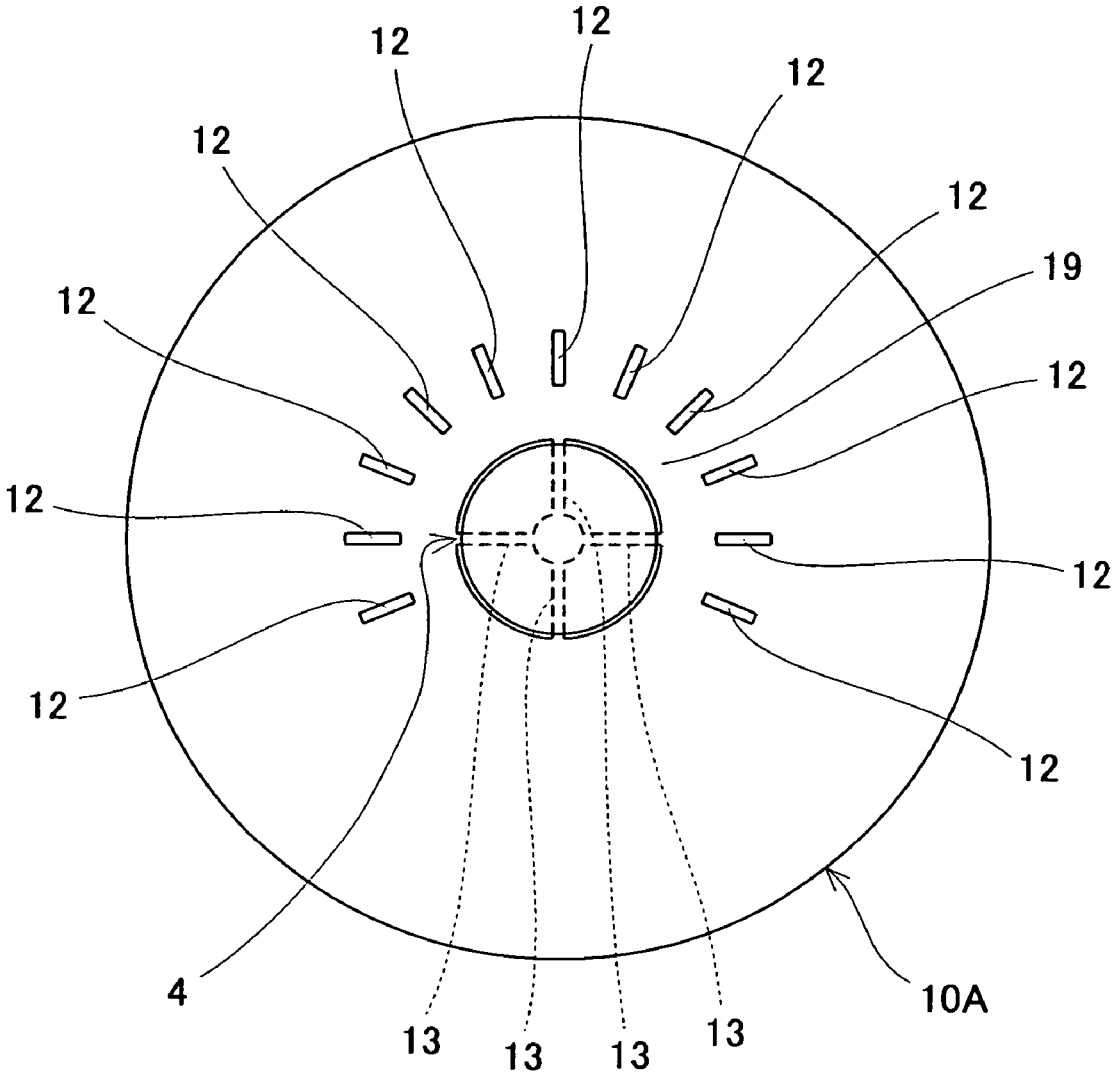
FIG. 2 is a front view of the wide dispersion speaker system.
Figure 3:
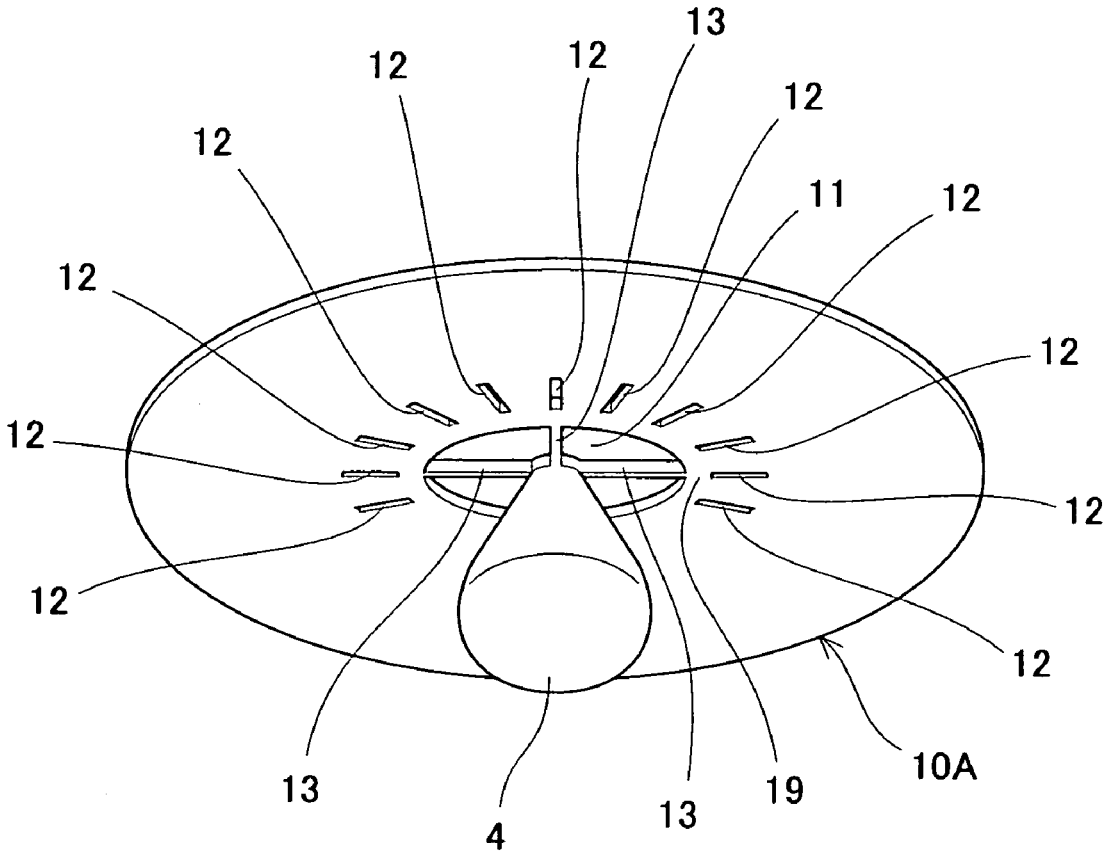
FIG. 3 is a perspective view of the wide dispersion speaker system mounted to the ceiling wall as viewed from obliquely below.

FIG. 1 is a longitudinal sectional view of a wide dispersion speaker system 1 mounted to a ceiling wall 30. FIG. 2 is a front view of the wide dispersion speaker system 1. FIG. 3 is a perspective view of the wide dispersion speaker system 1 mounted to the ceiling wall 30 as viewed from obliquely below.

The wide dispersion speaker system 1 comprises a power-driven cone type speaker unit 2, a restricting element 10A, and a diffuser 4.

A circular hole 30*a* is formed in the ceiling wall 30. The restricting element 10A is fitted into the mounting hole 30*a* and secured to the ceiling wall 30. In this manner, the wide dispersion speaker system 1 is mounted to the ceiling wall 30. As should be appreciated, the restricting element 10A of this embodiment functions as a mounting element by which the wide dispersion speaker system 1 is mounted to a wall, as well as a restricting element described later.

The cone type speaker unit 2 is mounted to the restricting element 10A from the rear face side. The cone type speaker unit 2 has a diaphragm 7. The diaphragm 7 has a conical portion 3 and an edge portion 5 provided around the conical portion 3. In FIG. 1, reference numeral 6 designates a boundary between the conical portion 3 and the edge portion 5. The diaphragm 7 of the cone type speaker unit 2 is covered by the restricting element 10A from forward.

The restricting element 10A is provided with a center hole 11 and a plurality of peripheral holes 12. The center hole 11 is positioned forward relative to a center section of the diaphragm 7 of the cone type speaker unit 2 and the peripheral holes 12 are positioned radially outward relative to the center hole 11. That is, the peripheral holes 12 are positioned to surround the center hole 11. A sum of opening areas of the center hole 11 and the plurality of peripheral holes 12 is smaller than an area of the diaphragm 7. That is, an apparent opening area of the diaphragm 7 is restricted by the restricting element 10A.

The restricting element 10A has an annular portion between the center hole 11 and the peripheral holes 12, which functions as a sound travel inhibiting portion 19. The sound travel inhibiting portion 19 has a structure for substantially inhibiting traveling of an acoustic wave. More specifically, the sound travel inhibiting portion 19 is not provided with holes, and therefore, the acoustic wave does not travel through the sound travel inhibiting portion 19. An element which substantially inhibits traveling of the acoustic wave may be employed as a sound travel inhibiting element, instead of the sound travel inhibiting element 19 having no holes in this embodiment. That is, an element having a few minute holes may be employed so long as it is capable of substantially inhibiting an acoustic wave. The sound travel inhibiting portion 19 is provided on outside of the center hole 11 to enable the restricting element 10A to effectively perform its function. That is, the apparent opening area of the diaphragm 7 cannot be restricted by the center hole 11 to widen directivity of the speaker system unless the sound travel inhibiting portion 19 which inhibits traveling of the acoustic wave is positioned on the outside of the center hole 11.

The diffuser 4 has entirely a droplet shape in which an upper half portion thereof is substantially conical and a lower half portion is substantially semi-spherical. The diffuser 4 is mounted at an upper end portion thereof by four support portions 13 extending from a peripheral edge of the center hole 11 of the restricting element 10A toward a center although the support portions 13 are omitted in FIG. 1, and is positioned forward relative to the center hole 11. The diffuser 4 has a diameter substantially equal to a diameter of the center hole 11. The diffuser 4 is mounted to widen directivity especially in a high frequency band. The center hole 11 may be formed to reduce the apparent opening area to thereby widen directivity in the high frequency band. But, if the center hole 11 is reduced excessively to widen the directivity, then a sound pressure level may be lowered. So, there is a limit to reduction of the center hole 11 to widen the directivity. It is anticipated that, by providing the diffuser 4, the directivity is widen especially in the high frequency band while ensuring a size of the center hole 11.

It shall be appreciated that a cover element (not shown) which is sound-transmissible may be mounted to cover the restricting element 10A and the diffuser 4 from forward.

Figure 4:
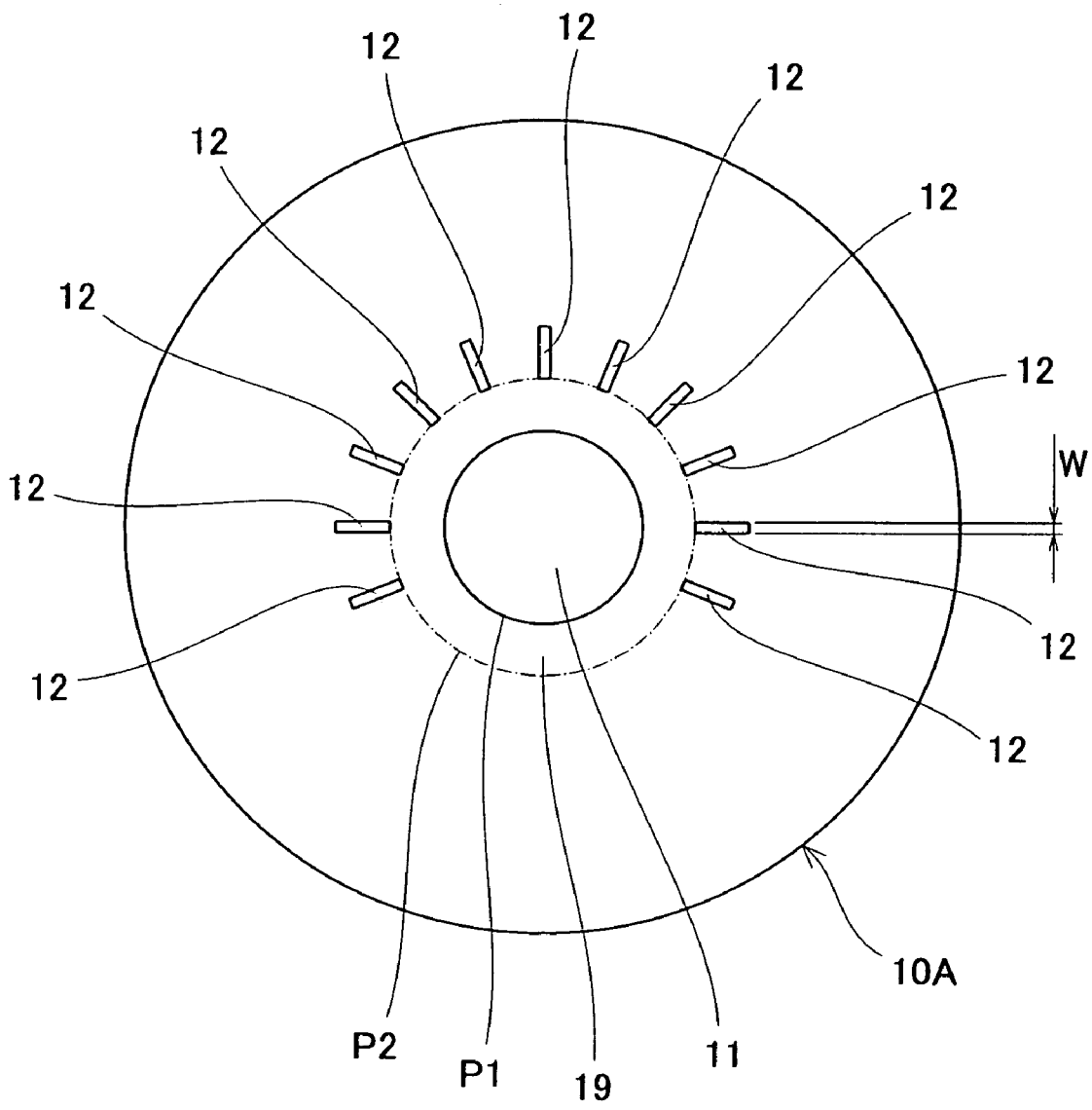
FIG. 4 is a front view of a restricting element, support portions of which are omitted.

FIG. 4 is a front view of the restricting element 10A, in which the support portions 13 are omitted. The circular center hole 11 is formed at a center section of the restricting element 10A. With the cone type speaker unit 2 mounted to the restricting element 10A, the center hole 11 is concentric with the cone type speaker unit 2. The area of the center hole 11 is desirably set to not less than 20% and not more than 50% of the area of the diaphragm 7 of the cone type speaker unit 2.

Eleven peripheral holes 12 are formed around the center hole 11 of the restricting element 10A. The peripheral holes 12 are formed by slits extending radially in order to minimize reduction of rigidity of the restricting element 10A. Since the peripheral holes 12 extend radially, the rigidity of the restricting element 10A is not substantially reduced regardless of formation of a number of peripheral holes 12. Therefore, the number of peripheral holes 12 may be set relatively freely, and a total area of these holes may be also set relatively freely The peripheral holes 12 may be distributed at intervals of 22.5 degrees in an angular range of approximately 225 degrees around a center axis of the cone type speaker unit 2. The peripheral holes 12 are positioned radially outward relative to the center hole 11 in the restricting element 10A. The peripheral holes 12 are positioned near and forward relative to the boundary 6 between the conical portion 3 and the edge portion 5 of the diaphragm 7. The peripheral holes 12 are positioned to be substantially equally spaced apart from the center axis in a radial direction. The total area of the eleven peripheral holes 12 is desirably set to not less than 1% and not more than 25% of the area of the center hole 11.

While the eleven peripheral holes 12 are arranged in the angular range of approximately 225 degrees around the center axis of the cone type speaker unit 2, there are no peripheral holes in remaining angular range (angular range of approximately 135 degrees). This means that the peripheral holes 12 are non-symmetric with respect to the center axis.

In FIG. 4, a circle P1 indicates a periphery of the center hole 11, i.e., a position of an outer end in the radial direction of the center hole 11. A circle P2 (circle indicated by a phantom line) indicates positions of inner ends in the radial direction of the peripheral holes 12. The annular region defined by the circles P1 and P2 corresponds to the sound travel inhibiting portion 19. That is, the outer end in the radial direction of the center hole 11 conforms to the inner end in the radial direction of the sound travel inhibiting portion 19, and the inner ends in the radial direction of the peripheral holes 12 conform to the outer end in the radial direction of the sound travel inhibiting portion 19.

Figure 5:
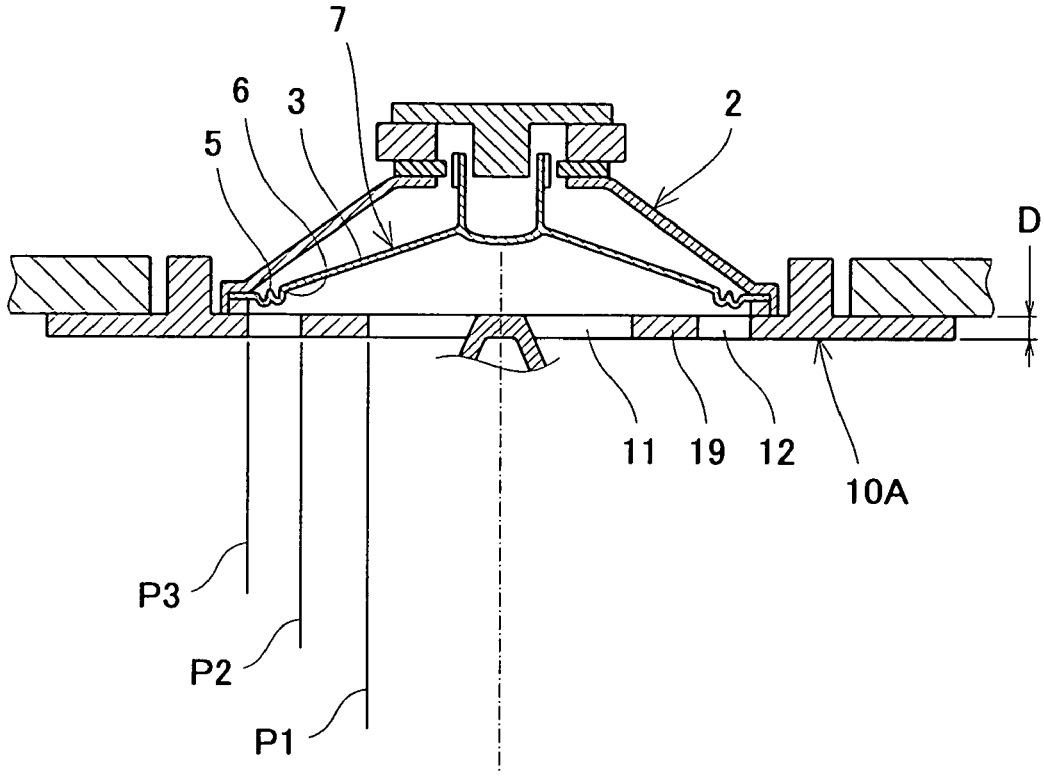
FIG. 5 is a longitudinal sectional view of the wide dispersion speaker system.

FIG. 5 is a longitudinal sectional view of the wide dispersion speaker system 1. A lead line P1 in FIG. 5 indicates the position of the outer end in the radial direction of the center hole 11 (position of the inner end in the radial direction of the sound travel inhibiting portion 19). A lead line P2 indicates the position of the inner ends in the radial direction of the peripheral holes 12 (position of the outer end in the radial direction of the sound travel inhibiting portion 19). A lead line P3 indicates the positions in the radial direction of the peripheral holes 12.

The line P1 is about 30 mm distant from the center axis indicated by a dashed line. The line P2 is about 45 mm distant from the center axis. The line P3 is about 54 mm distant from the center axis.

As can be seen from FIG. 5, the line P2 is positioned at a substantially middle point between the lines P1 and P3. Thus, it is desirable that the outer end in the radial direction of the sound travel inhibiting portion 19 be positioned at the substantially middle point between the outer end in the radial direction of the center hole 11 and the outer ends in the radial direction of the peripheral holes 12 or otherwise be positioned radially outward relative to the substantially middle point. This is because, if a radial width of the sound travel inhibiting portion 19 is too small, then the center hole 11 of the restricting element 10A does not effectively produce a restricting effect.

As should be appreciated from FIG. 5, the line P3 is positioned in the vicinity of a peripheral edge portion of the diaphragm 7 in the radial direction. The outer ends in the radial direction of the peripheral holes 12 are thus positioned in the vicinity of the peripheral edge portion of the diaphragm 7 so that the peripheral holes 12 are disposed at an outermost position in the radial direction.

A depth D of the peripheral holes 12 is illustrated in FIG. 5. The depth D is equal to a thickness of the restricting element 10A, while a slit width W of the peripheral holes 12 is illustrated in FIG. 4. The width W of the peripheral holes 12 is smaller than the depth D. Such a structure produces a resistance to the acoustic wave traveling through the peripheral holes 12 especially in the high-frequency band. In the wide dispersion speaker system 1, the acoustic wave generated by the diaphragm 7 is radiated to outside through the center hole 11 and the peripheral holes 12. Since the peripheral holes 12 produce a resistance to traveling of the acoustic wave, the acoustic wave traveling through the peripheral holes 12 is not predominant in the directivity of the wide dispersion speaker system 1.

Subsequently, a function of the wide dispersion speaker system 1 will be described.

Figure 6:
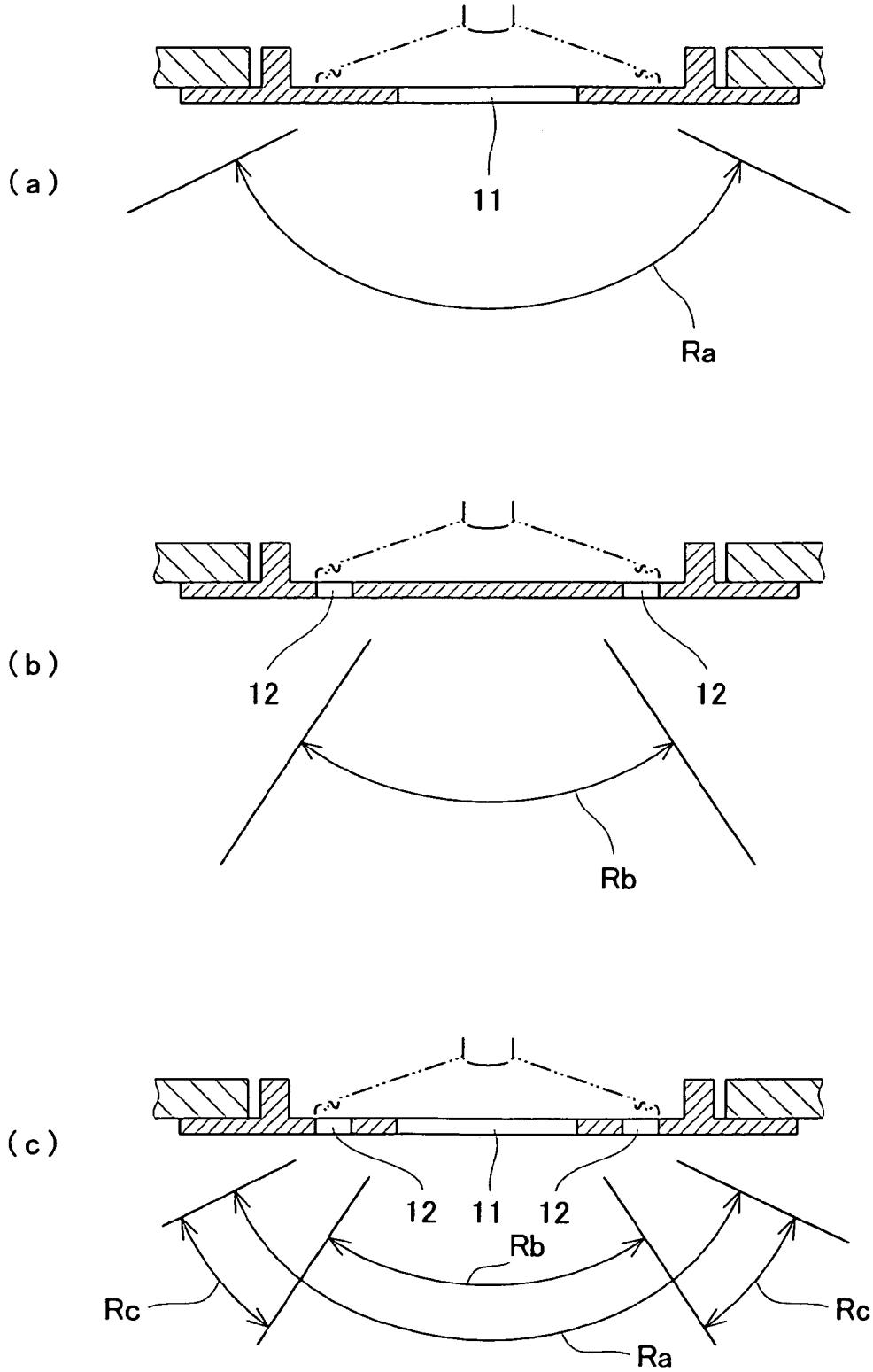
FIGS. 6(*a*) to 6(*c*) are views schematically showing a function of the wide dispersion speaker system.

FIGS. 6(*a*) to 6(*c*) are views schematically showing a function of the wide dispersion speaker system 1. As described above, in the wide dispersion speaker system 1, the acoustic wave generated by the diaphragm 7 is radiated to outside through the center hole 11 and the peripheral holes 12. Here, it is assumed that the two types of holes (center hole 11 and the peripheral holes 12) are independent sound sources.

FIG. 6(*a*) schematically shows a directional angle assuming that only the center hole 11 is the sound source. In FIG. 6(*a*), Ra indicates the directional angle. The center hole 11 has a diameter sufficiently smaller than the diaphragm 7, and hence the acoustic wave from the center hole 11 has a relatively large directional angle even in a relatively high frequency.

FIG. 6(*b*) schematically shows a directional angle assuming that only the peripheral holes 12 are the sound source. In FIG. 6(*b*), Rb indicates the directional angle. The peripheral holes 12 are positioned near and forward relative to the boundary 6 between the conical portion 3 and the edge portion 5 of the diaphragm 7. The diaphragm 7 exhibits a behavior substantially the same as vibration of only its center section in a relatively high frequency region. Assuming that the peripheral holes 12 are a virtual sound source, they have a directional angle similar to that generated by the vibration of the peripheral portion of the diaphragm 7 (i.e., the peripheral edge portion or the edge portion 5 of the conical portion 3). Therefore, the acoustic wave from the peripheral holes 12 has a relatively small directional angle.

FIG. 6(*c*) is a view schematically showing directional angles of the sound sources (the center hole 11 and the peripheral holes 12) in an overlapping state. The center hole 11 as the sound source and the peripheral holes 12 as the sound source typically have a phase difference. This causes phase interference to occur between the acoustic wave from the center hole 11 and the acoustic wave from the peripheral holes 12. Such phase interference is especially noticeable in an angular range in which the directional angles of the sound sources overlap with each other. In FIG. 6(*c*), the directional angle of the acoustic wave from the center hole 11 is indicated by Ra, and the directional angle of the acoustic wave from the peripheral holes 12 is indicated by Rb. The angular range in which the directional angles overlap with each other is indicated by Rb. Since the total area of the peripheral holes 12 is smaller than the area of the center hole 11, and the slit width W of the peripheral holes 12 is smaller than the depth D of the peripheral holes 12, the peripheral holes 12 produce a resistance to traveling of the acoustic wave. As a result, the acoustic wave from the peripheral holes 12 is less predominant than the acoustic wave from the center hole 11. Nonetheless, it may be assumed that a sound pressure level (sound pressure level in the case where the center hole 11 and the peripheral holes 12 are the sound sources) becomes lower than that in the case where only the center hole 11 is the sound source due to the phase interference in the angular range of Rb.

On the other hand, in outside of the angular range Rb within the angular range Ra (i.e., angular range Rc), noticeable phase interference does not occur because the level of the acoustic wave from the peripheral holes 12 is lower. From this, it may be assumed that the sound pressure level (sound pressure level in the case where the center hole 11 and the peripheral holes 12 are the sound sources) is substantially equal to that in the case where only the center hole 11 is the sound source in the angular range Rc. Thereby, the degree to which the sound pressure levels are added becomes lower in the direct-front range (angular range Rb) in contrast to the case in FIG. 6(*a*). As a result, the directivity of the wide dispersion speaker system 1 is widened.

Figure 7:
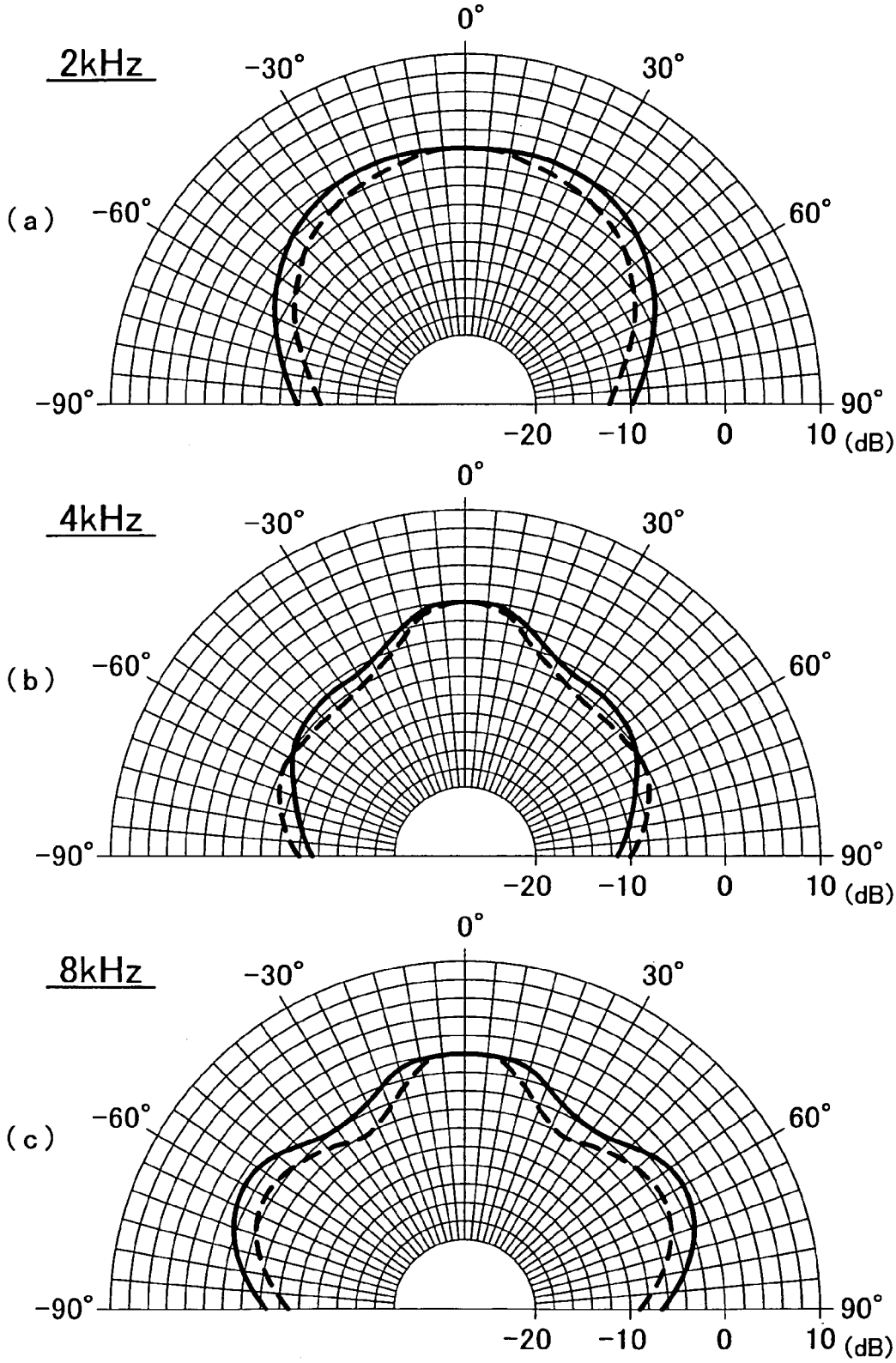
FIGS. 7(*a*) to 7(*c*) are views showing directional patterns measured in frequencies, in which FIG. 7(*a*) is a directional pattern measured in a frequency of 2 kHz, FIG. 7(*b*) is a directional pattern measured in a frequency of 4 kHz, and FIG. 7(*c*) is a directional pattern measured in a frequency of 8 kHz.
Figure 8:
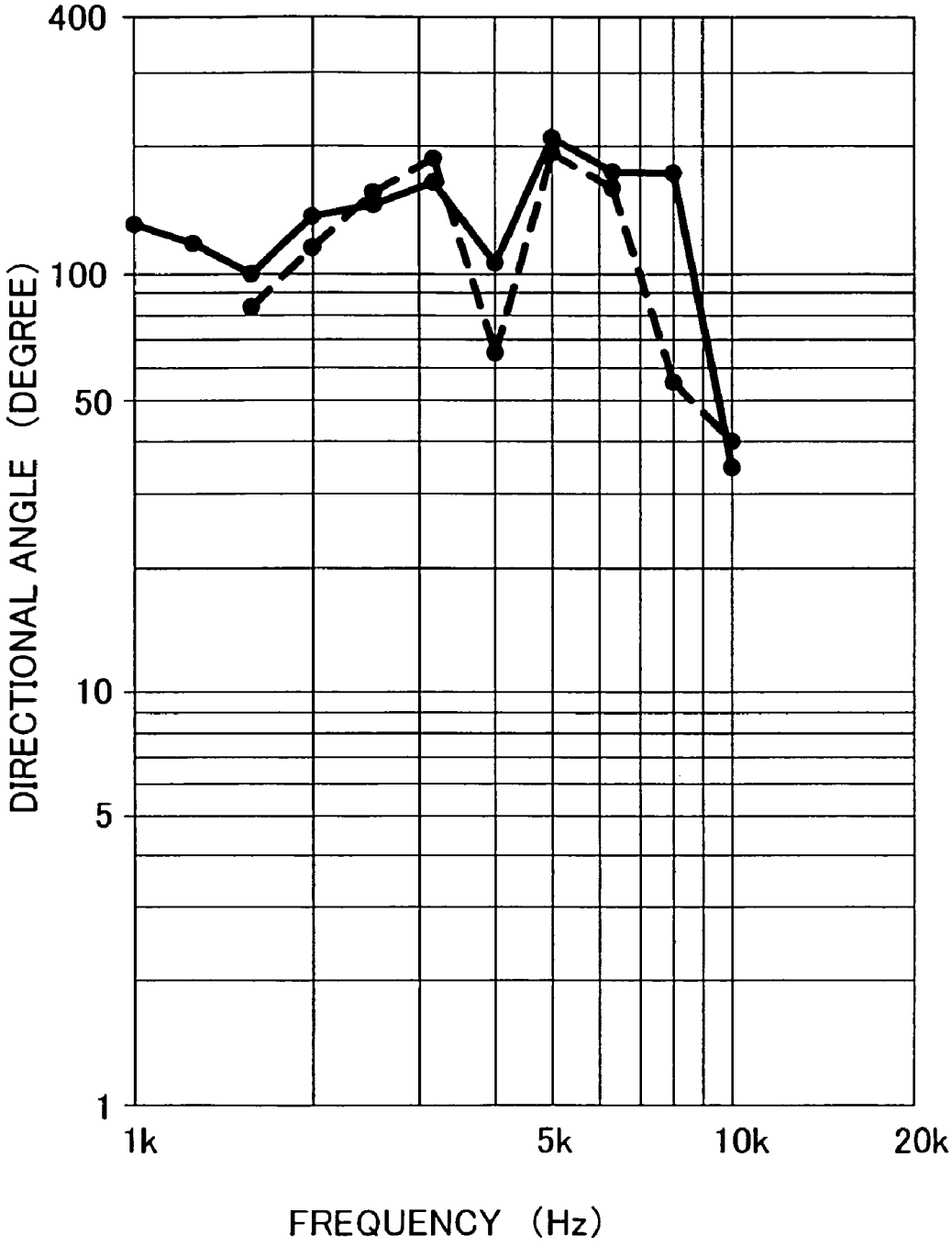
FIG. 8 is a frequency characteristic view of a directional angle measured in frequencies of 1 to 10 kHz.

The applicant measured the directivities of two types of speaker systems S1 and S2 owned by the applicant. The speaker system S1 is similar to the wide dispersion speaker system 1 shown in FIGS. 1 to 5, and the speaker system S2 is a speaker system for the purpose of comparison. The difference between the speaker systems S1 and S2 is only the presence/absence of the peripheral holes. That is, the speaker system S2 has no peripheral holes. The other structure is identical to that of the speaker system S1. FIGS. 7 and 8 show measurements of the directivities of the speaker systems S1 and S2.

FIGS. 7(*a*) to 7(*c*) are views showing directional patterns measured in respective frequencies, in which FIG. 7(*a*) shows a directional pattern measured in a frequency of 2 kHz, FIG. 7(*b*) is a directional pattern measured in a frequency of 4 kHz, and FIG. 7(*c*) is a directional pattern measured in a frequency of 8 kHz. In FIGS. 7(*a*) to 7(*c*), the directional patterns of the speaker system 1 are indicated by solid lines and the directional patterns of the speaker system 2 are indicated by broken lines. It shall be appreciated that the directivity of the speaker system S1 is larger than the speaker system 2 in each frequency.

FIG. 8 is a view showing a frequency characteristic of directional angles (open angles in two directions at which the sound pressure level thereof is lower by 6 dB than the sound pressure level in the direct-front range). In FIG. 8, the characteristic indicated by a solid line is that of the speaker system S1, and the characteristic indicated by a broken line is that of the speaker system S2. It shall be appreciated that the directional angle is larger in the speaker system S1 than the speaker system S2 in most of a frequency range of 1 to 10 kHz.

As described previously, in the wide dispersion speaker system 1 of FIGS. 1 through 5, the eleven peripheral holes 12 may be distributed in the angular range of approximately 225 degrees around the center axis of the cone type speaker unit 2, while the peripheral holes 12 are not formed in the remaining angular range, and therefore, the peripheral holes 12 are arranged non-symmetrically with respect to the center axis.

The peripheral holes 12 are arranged non-symmetrically to avoid occurrence of a sharp dip in the frequency characteristic of the sound pressure level in the direct-front range.

In the wide dispersion speaker system 1, it may be assumed that the sharp dip occurs in the frequency characteristic of the sound pressure level in the direct-front range due to the interference between the acoustic wave from the center hole 11 and the acoustic wave from the peripheral holes 12. In order to alleviate the dip, the peripheral holes 12 are arranged non-symmetrically with respect to the center axis.

It may be assumed that, by closing the peripheral holes 12 in a part of the angular range so that the peripheral holes 12 become non-symmetric, configuration of interference becomes more complex, and hence extreme interference between the acoustic waves in specific frequencies is avoided, although the sharp dip may occur due to the interference in the structure in which the peripheral holes 12 are arranged at equal angle intervals over the entire periphery around the center axis (entire angular range around the center axis).

Figure 9:
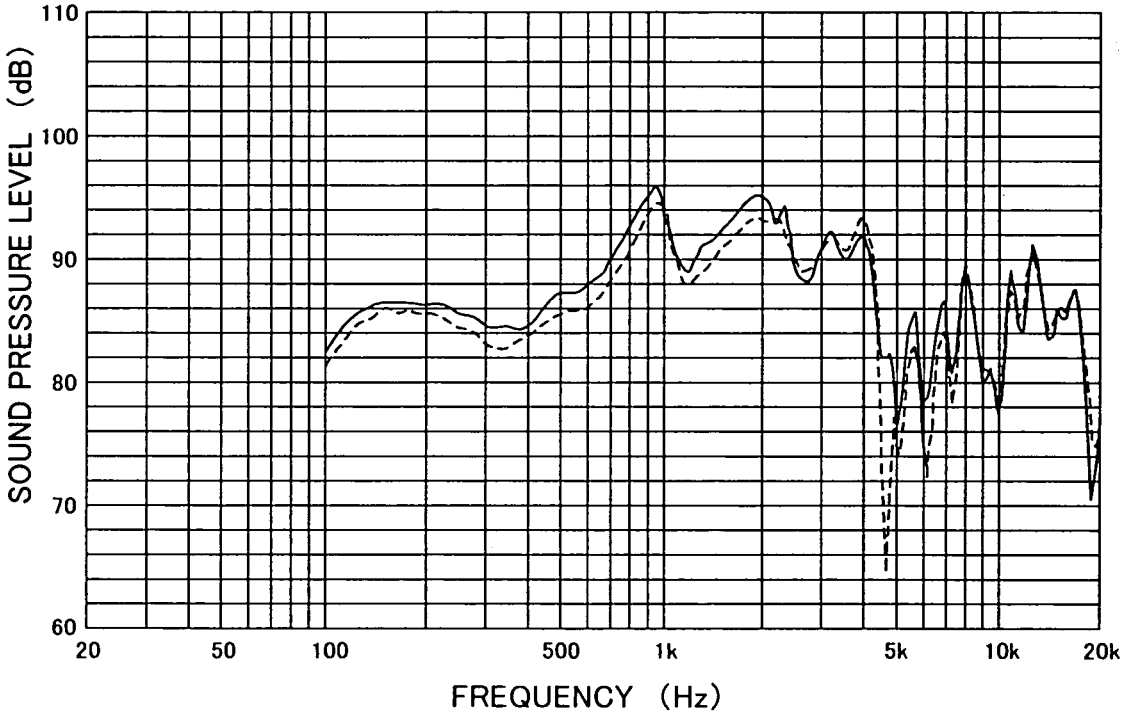
FIG. 9 is a sound pressure level frequency characteristic view in a direct-front range, showing measurements of two speaker systems owned by the applicant of the present invention.
Figure 10:
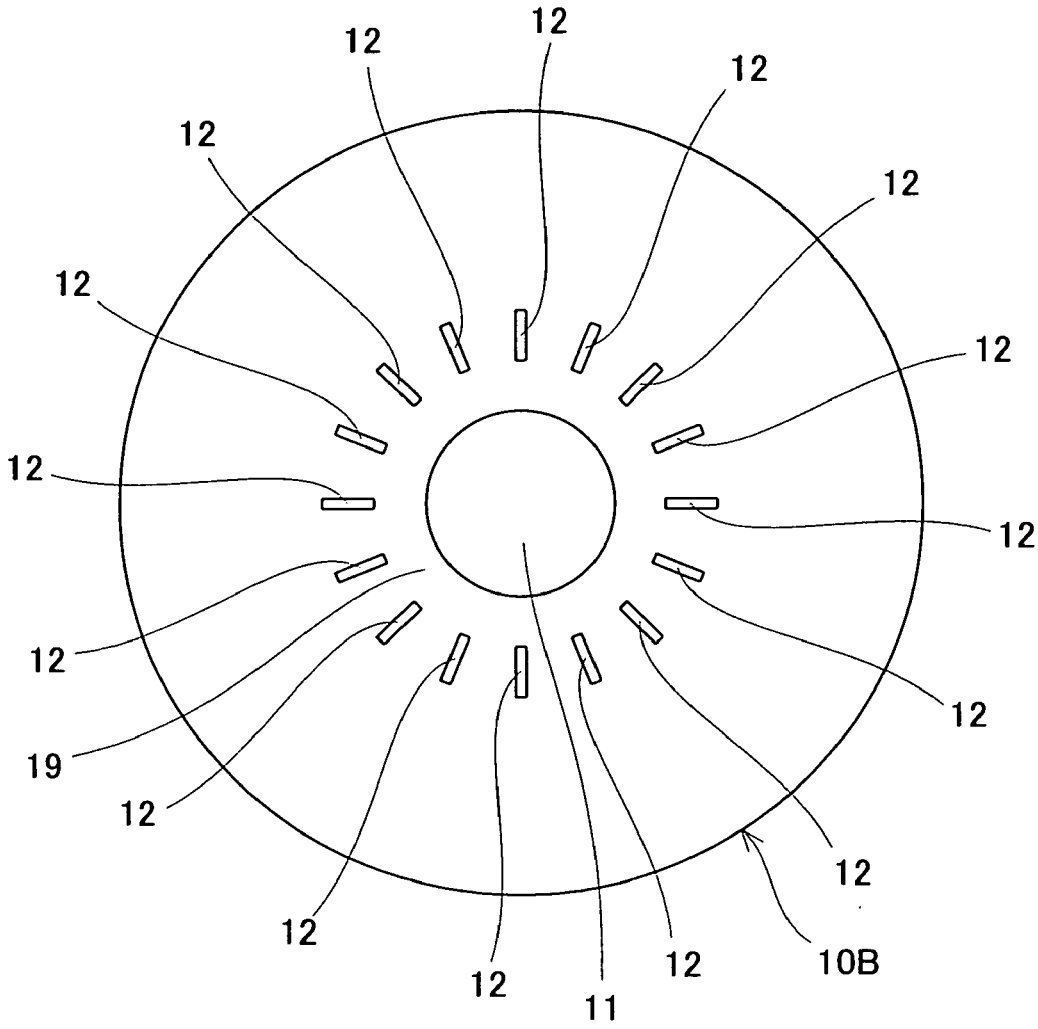
FIG. 10 is a front view of a restricting element.

FIG. 9 shows measurements of sound pressure level frequency characteristics in the direct-front range of two speaker systems S3 and S4 owned by the applicant of the present invention. The speaker system S3 has a structure similar to that of the wide dispersion speaker system 1 shown in FIGS. 1 to 5. The speaker system S4 has a restricting element 10B of FIG. 10. FIG. 10 is a front view of the restricting element 10B. The speaker system S4 is an embodiment of the present invention, in which sixteen peripheral holes 12 are arranged at equal angle intervals over the entire periphery, unlike the speaker system S3. The other structure is identical to that of the speaker system S3.

In FIG. 9, the sound pressure level indicated by a solid line is that of the speaker system S3, and the sound pressure level indicated by a broken line is that of the speaker system S4. As can be seen from FIG. 9, the sharp dip occurs in the speaker system S4 in the frequencies of about 4.5 kHz, about 6.1 kHz, and about 7.2 kHz, whereas these dips are eliminated or alleviated in the speaker system S3.

Thus far, one embodiment of the wide dispersion speaker system according to the present invention has been described with reference to FIGS. 1 through 10. Hereinbelow, another embodiment of the present invention will be described.

Figure 11:
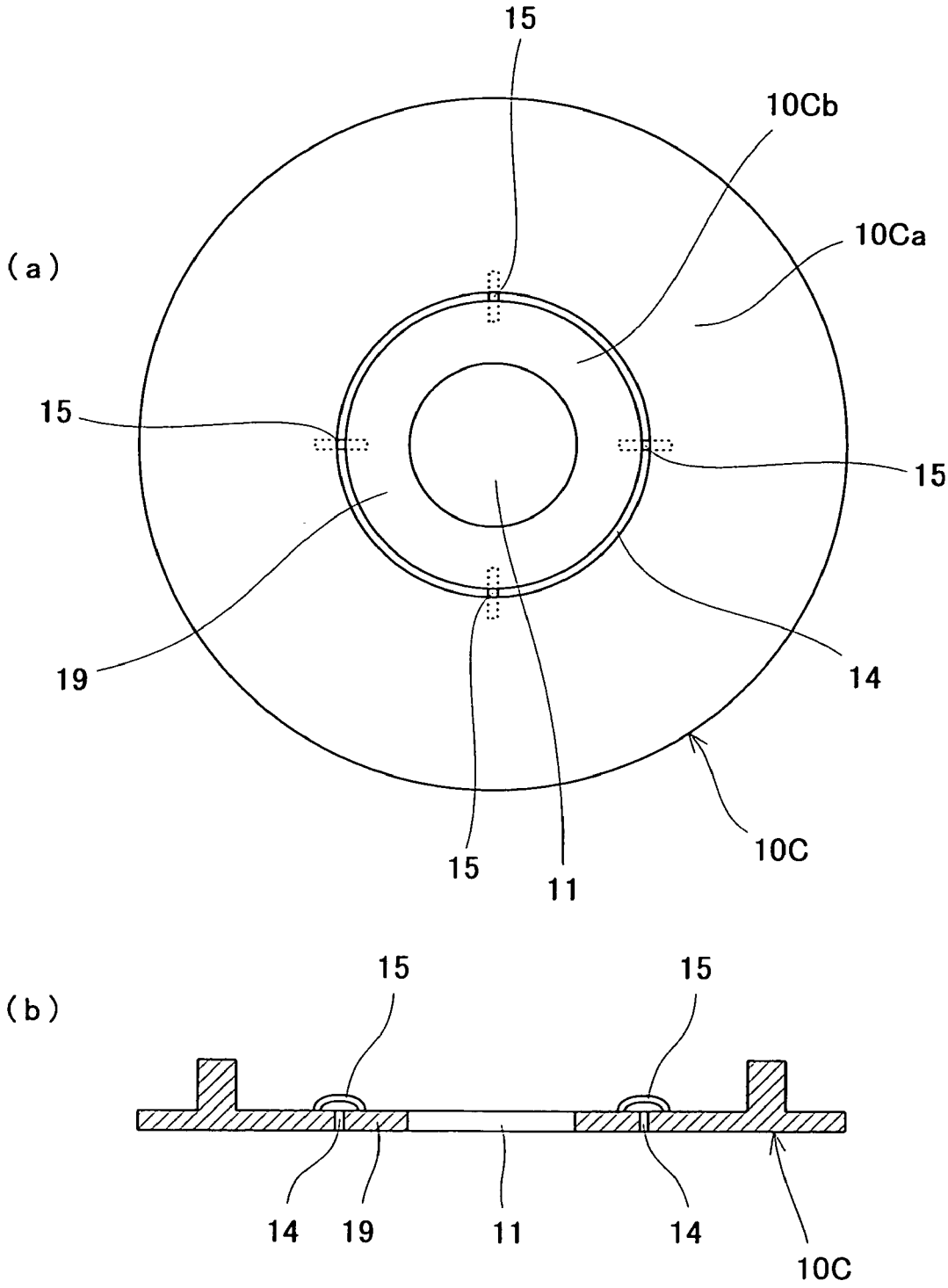
FIG. 11(*a*) is a front view of the restricting element and FIG. 11(*b*) is a longitudinal sectional view of the restricting element.

FIGS. 11(*a*) is a front view of a restricting element 10C and FIG. 11(*b*) is a longitudinal sectional view of the restricting element 10C. In the wide dispersion speaker system in FIG. 1, the restricting element 10A may be replaced by the restricting element 10C of FIG. 11. The restricting element 10C of FIG. 11 is provided with a peripheral hole 14 formed to surround a substantially entire periphery of the center hole 11. A region 10Cb located inward relative to the peripheral hole 14 of the restricting element 10C is supported by four support members 15 extending from a region 10Ca located radially outward relative to the peripheral hole 14. In the restricting element 10C, the peripheral hole 14 is symmetric with respect to the center axis of the cone type speaker unit 2.

Figure 12:
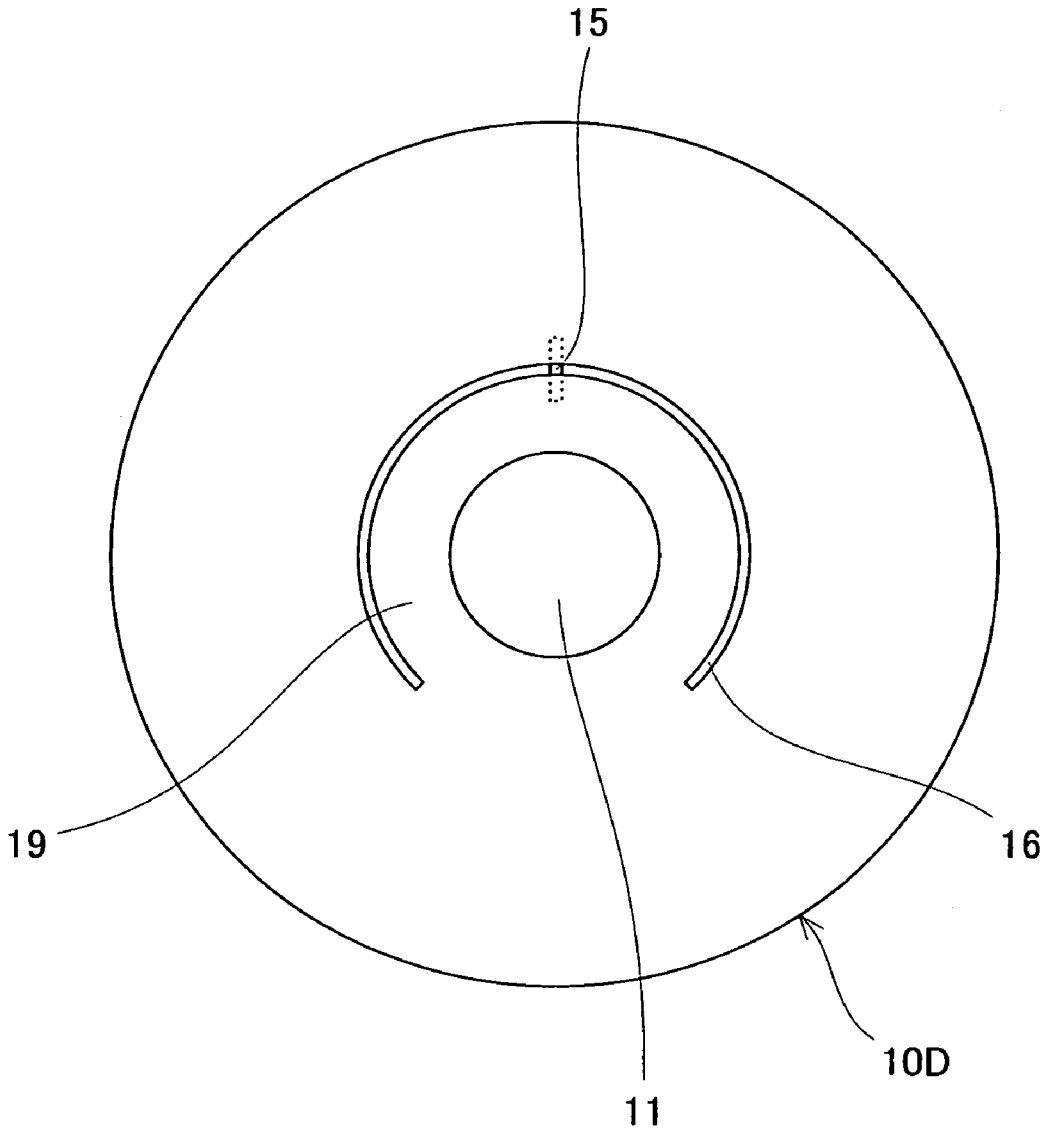
FIG. 12 is a front view of the restricting element.

FIG. 12 is a front view of a restricting element 10D. In the wide dispersion speaker system of FIG. 1, the restricting element 10A may be replaced by the restricting element 10D of FIG. 12. The restricting element 10D of FIG. 12 is provided with a peripheral hole 16. The peripheral hole 16 is formed to extend so as to surround the center hole 11 in an angular range of about 270 degrees around the center axis of the cone type speaker unit 2. In the restricting element 10D, the peripheral hole 16 is non-symmetric with respect to the center axis of the cone type speaker unit 2.

Figure 13:
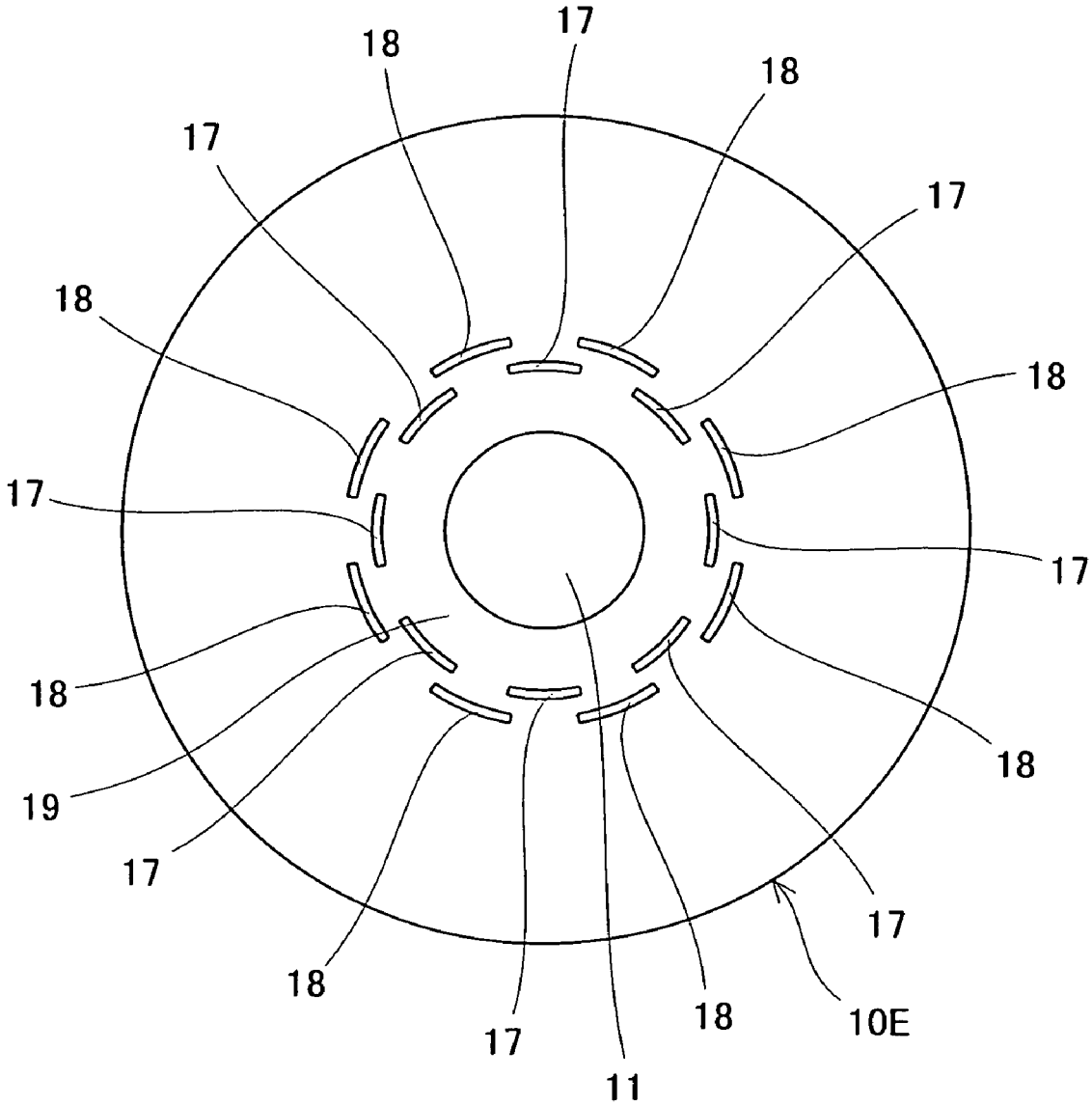
FIG. 13 is a front view of the restricting element.

FIG. 13 is a front view of a restricting element 10E. In the wide dispersion speaker system 1 in FIG. 1, the restricting element 10A may be replaced by the restricting element 10E of FIG. 13. In the restricting element 10E of FIG. 13, sixteen peripheral holes 17 and 18 of a slit shape are distributed to extend circumferentially to surround a substantially entire periphery of the center hole 11. In the restricting element 10E, the peripheral holes 17 and 18 are symmetric with respect to the center axis of the cone type speaker unit 2.

Figure 14:
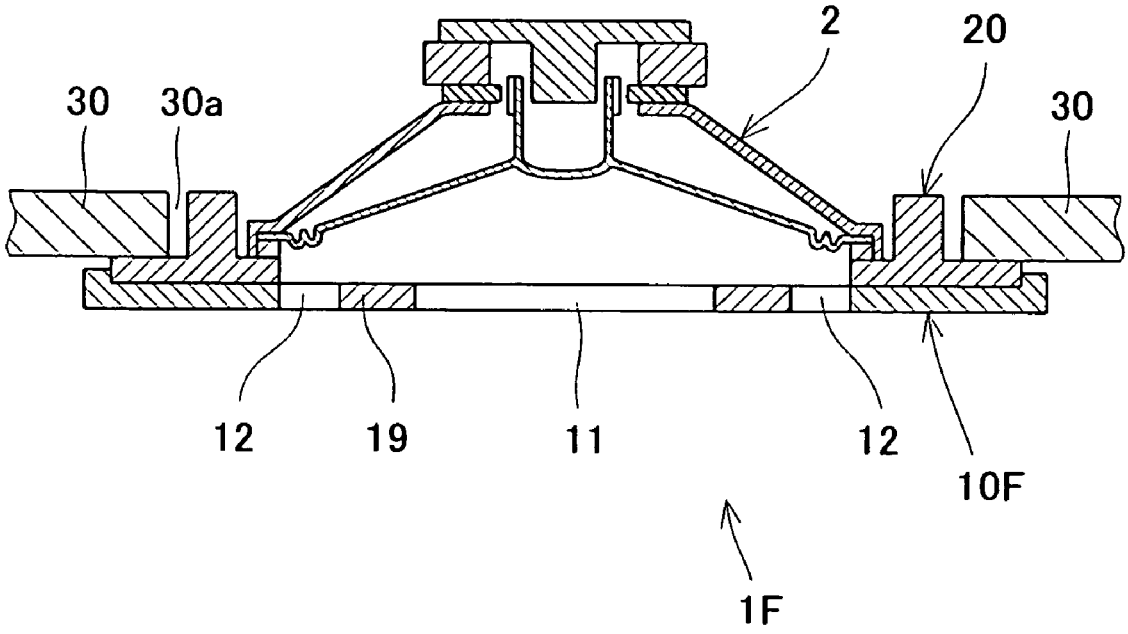
FIG. 14 is a longitudinal sectional view of the wide dispersion speaker system.

FIG. 14 is a longitudinal sectional view of a wide dispersion speaker system 1F. The wide dispersion speaker system 1F comprises the cone type speaker unit 2, a restricting element 1OF, and a mounting element 20. The wide dispersion speaker system 1F is mounted to the ceiling wall 30 in such a manner that the mounting element 20 is fitted into the circular mounting hole 30*a* formed on the ceiling wall 30. The cone type speaker unit 2 is mounted to the mounting element 20 from a rear face side, and the restricting element 10F is mounted to the mounting element 20 from a front face side. The restricting element 10F is a panel-shaped element provided with the center hole 11 and the peripheral holes 12. While the restricting member 10A of FIG. 1 functions as a mounting element, the restricting element 10F of FIG. 14 does not function as the mounting element. In addition, while the wide dispersion speaker system 1 of FIG. 1 has the diffuser 4, the wide dispersion speaker system 1F of FIG. 14 does not have a diffuser. The wide dispersion speaker system 1F of FIG. 14 is also an embodiment of the present invention.

Thus far, the embodiment of the wide dispersion speaker system of the present invention having various configurations has been described with reference to FIGS. 1 through 14. The cone type speaker unit is not intended to be limited to the power-driven type described above, but speaker units having other drive systems may be employed. In addition, the diaphragm of the cone type speaker unit having edge portions may be configured to be edgeless.

While the speaker system is applied to the ceiling-embedded speaker system in the embodiments described above, it may alternatively be applied to other speaker systems, for example, a box type speaker system.

Embodiment 2

Subsequently, a second embodiment of the present invention will be described with reference to the drawings. First of all, a schematic construction of a ceiling-embedded speaker system to which a cover mounting structure of the embodiment of the present invention is applied will be described with reference to FIGS. 15 to 20. As used hereinbelow, a side toward which a cover is rotated to engage with a speaker system body is defined as a back side in the circumferential direction. In addition, a back end in the rotational direction is defined as a tip end, and an opposite end is defined as a base end. Further, since the cell-embedded speaker system is mounted to the ceiling face which is a flat portion, facing downward, downward is defined as forward and upward is defined as rearward.

Figure 15:
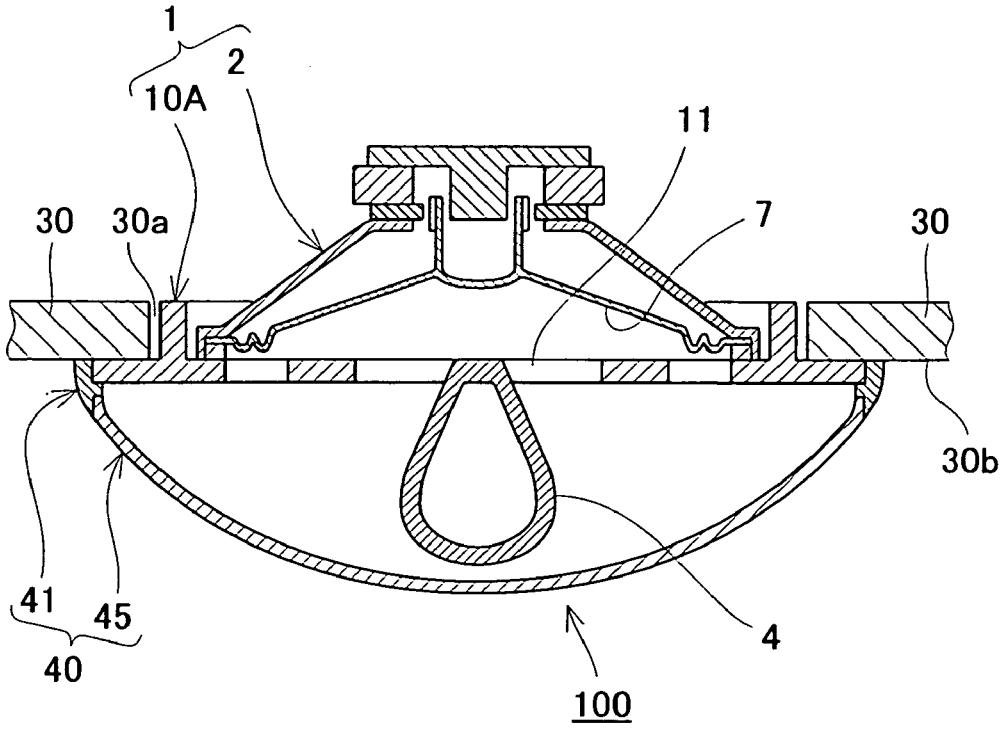
FIG. 15 is a longitudinal sectional view of a ceiling-embedded speaker system mounted to a ceiling wall.

FIG. 15 is a longitudinal sectional view of a ceiling-embedded speaker system 100 mounted to the ceiling wall 30. A ceiling face of the ceiling wall 30 is a flat portion. The ceiling-embedded speaker system 100 comprises the speaker system body (wide dispersion speaker system) 1 and a sound-transmissible cover 40.

The circular opening (mounting hole) 30*a* is formed in the ceiling wall 30. The speaker system body 1 is fitted into the opening 30*a*. The speaker system body 1 mainly comprises the speaker unit (cone type speaker unit) 2 and the mounting element (restricting element) 10A. The circular hole (center hole) 11 is formed in the center section of the mounting element 10A. The diaphragm 7 of the speaker unit 2 mounted to a rear face side of the mounting element 10A is configured to be visible through the circular hole 11. The speaker system body 1 is directly and securely mounted to the ceiling face 30*b* in such a manner that the mounting element 10A with the speaker unit 2 mounted on the rear face side is secured to the ceiling wall 30. The cover 40 is mounted to the mounting element 10A to cover a front face of the diaphragm 7 of the speaker unit 2. Reference numeral 4 denotes the diffuser.

Figure 16:
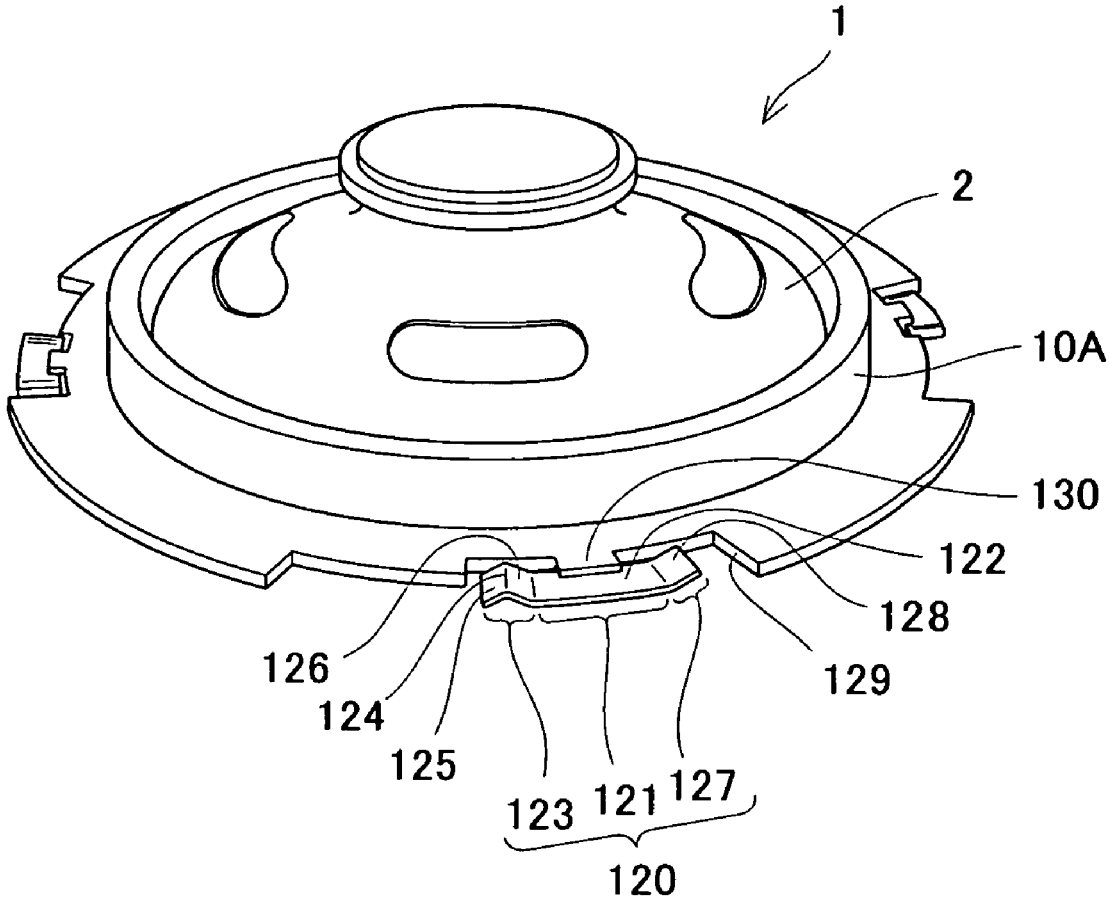
FIG. 16 is a perspective view of a speaker system body as viewed from a rear face side.
Figure 17:
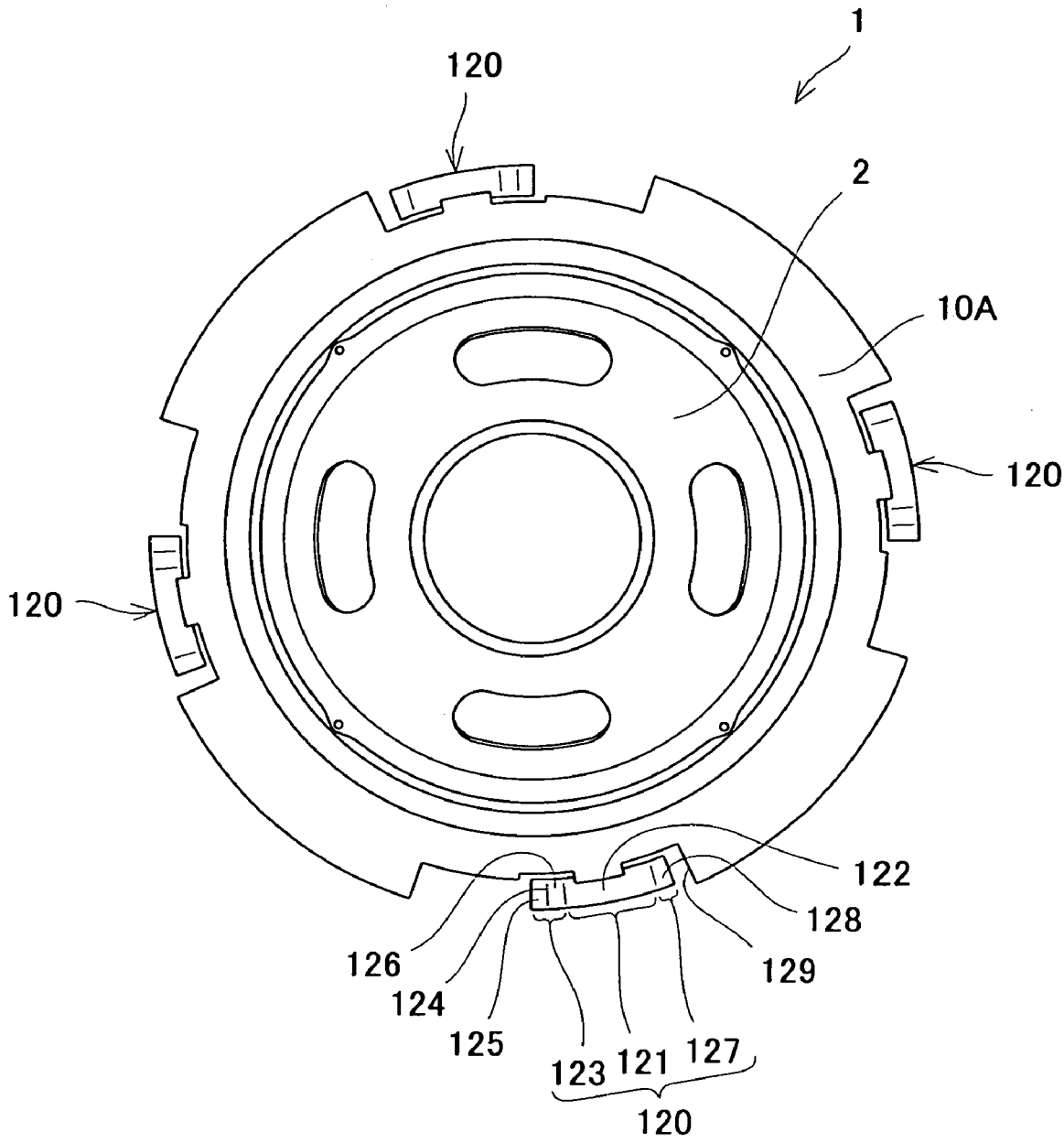
FIG. 17 is a back view of the speaker system body.

FIG. 16 is a perspective view of the speaker system body 1 as viewed from the rear face side. FIG. 17 is a back view of the speaker system body 1. A peripheral edge portion of the mounting element 10A is substantially circular. Four body engagement portions 120 are arranged at equal angle intervals in the peripheral edge portion of the mounting element 10A so as to protrude radially outward. The mounting element 10A, including the body engagement portions 120 has a unitary molded structure made of synthetic resin.

The body engagement portion 120 is a plate of a substantially rectangular shape extending in the circumferential direction. The body engagement portion 120 includes a horizontal portion 121, a first protrusion 123, and a second protrusion 127.

The horizontal portion 121 extends horizontally in a center section in the circumferential direction of the body engagement portion 120. The horizontal portion 121 has a rear face (upper face) 122 which is a horizontal face.

The first protrusion 123 is formed continuously with a base end in the circumferential direction of the horizontal portion 121 to protrude rearward (upward) relatively to the rear face 122. The first protrusion 123 has inclined faces 125 and 126 which are inclined obliquely forward (obliquely downward) from a top portion 124 in opposite directions in the circumferential direction.

The second protrusion 127 is formed continuously with a tip end in the circumferential direction of the horizontal portion 121 to protrude rearward (upward) further than the rear face 122. The second protrusion 127 has an inclined face 128 which extends to be inclined obliquely rearward (obliquely upward)) from the tip end of the horizontal portion 121 to the back side in the circumferential direction.

A contact face 129 is formed on the back side of the second protrusion 127 in the circumferential direction of the speaker system body 1 so as to be spaced a predetermined distance apart from the second protrusion 127. The contact face 129 is a substantially vertical face and is configured to face the second protrusion 127.

Figure 18:
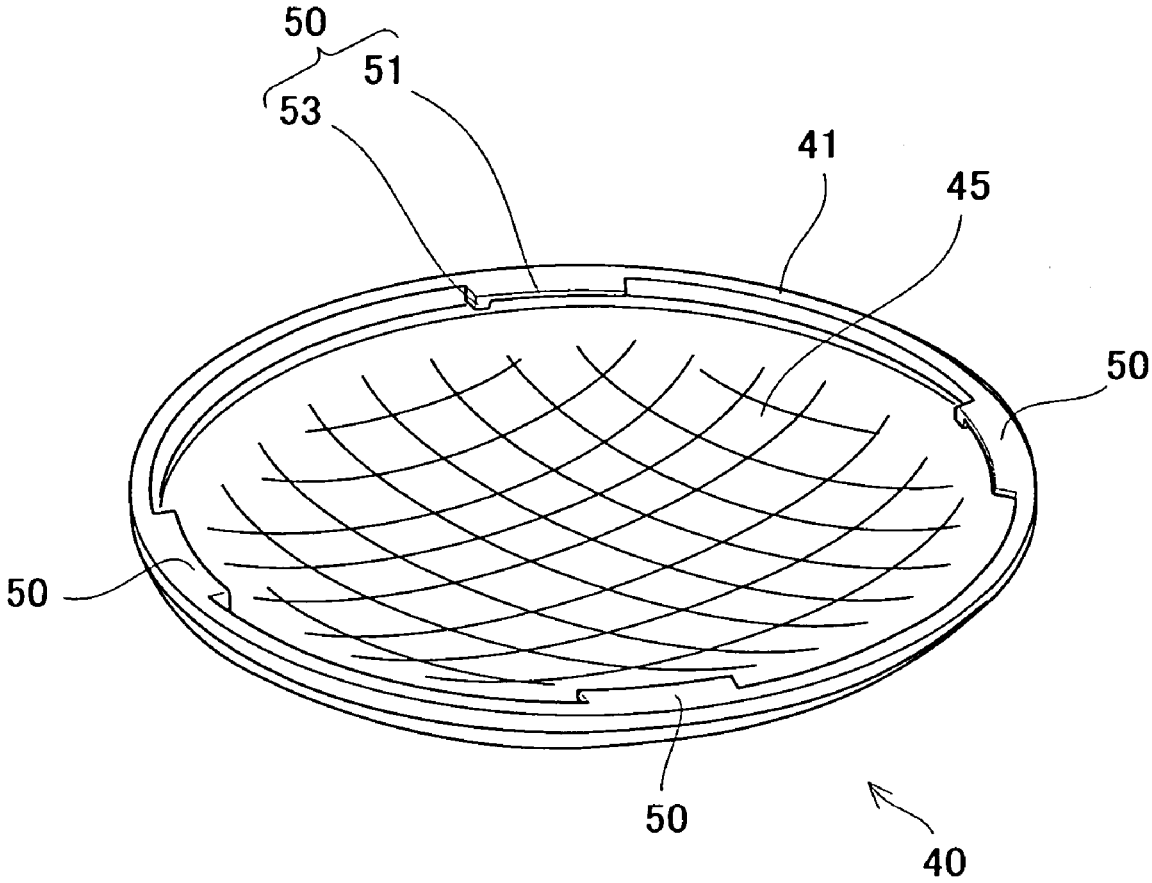
FIG. 18 is a perspective view of a cover as viewed from a rear face side.
Figure 19:
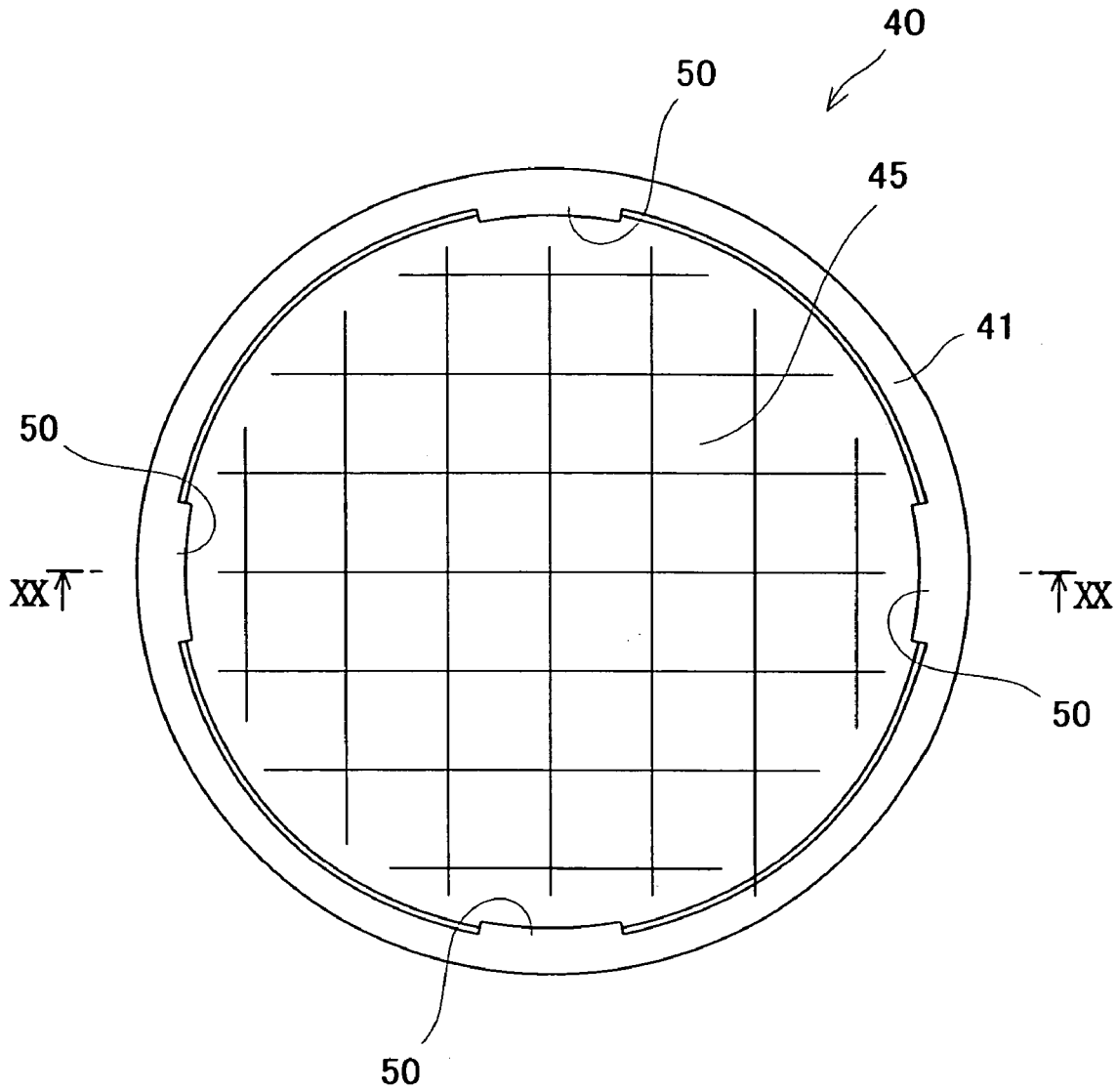
FIG. 19 is a back view of the cover.
Figure 20:
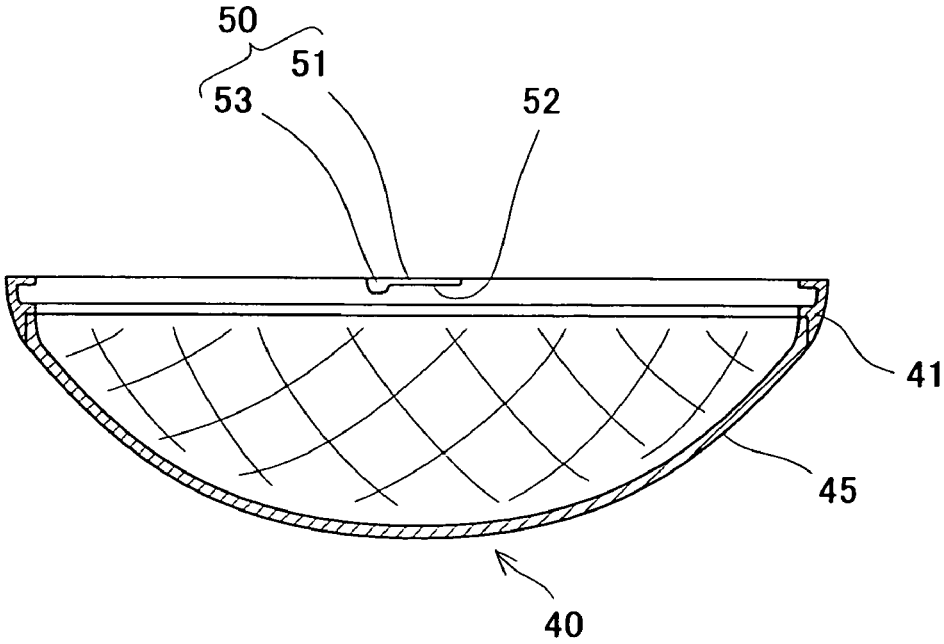
FIG. 20 is a cross-sectional view taken in the direction of arrows substantially along line XX-XX of FIG. 19.

FIG. 18 is a perspective view of the cover 40 as viewed from the rear face side. FIG. 19 is a back view of the cover 40. FIG. 20 is a cross-sectional view taken in the direction of arrows substantially along line XX-XX of FIG. 19.

The cover 40 has a frame 41 and a net element 45. The frame 41 forms a peripheral edge portion of the cover 40 and is substantially annular. Therefore, the peripheral edge portion of the cover 40 is substantially circular. The net element 45 is securely mounted to the frame 41 to protrude forward (downward) from the frame 41.

Four cover engagement portions 50 are formed to be arranged at equal angle intervals in the frame 41 to protrude radially inward. The frame 41, including the cover engagement portions 50, has a unitary molded structure made of synthetic resin.

The cover engagement portions 50 are positioned in the cover 40 so as to correspond to the body engagement portions 120. The radial positions of the body engagement portions 120 in the speaker system body 1 substantially conform to the radial positions of the cover engagement portions 50 of the cover 40.

The cover engagement portion 50 is a plate of a substantially rectangular shape extending in the circumferential direction. The cover engagement portion 50 includes a horizontal portion 51 and a third protrusion 53.

The horizontal portion 51 of the cover engagement portion 50 extends horizontally and its front face (lower face) 52 is a horizontal face (see FIG. 20). A third protrusion 53 is formed continuously with a tip end in the circumferential direction of the horizontal portion 51 so as to protrude forward (downward) further than the front face 52.

Subsequently, a procedure for mounting the cover 40 to the speaker system body 1 secured to the ceiling wall 30 will be described with reference to FIGS. 21 to 24.

Figure 21:
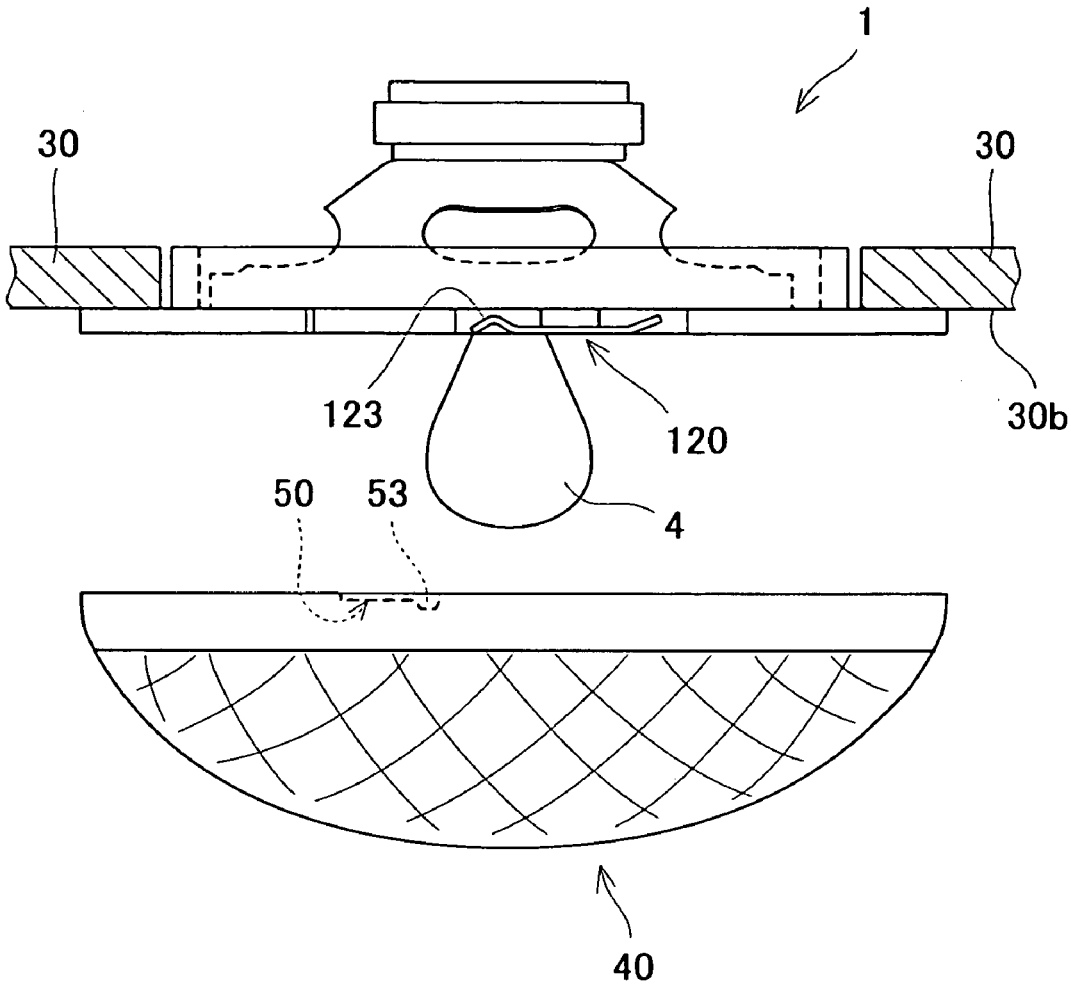
FIG. 21 is a side view of the speaker system body secured to the ceiling wall and the cover mounted to the speaker system body.

FIG. 21 is a side view of the speaker system body 1 secured to the ceiling wall 30 and the cover 40 which is going to be mounted to the speaker system body 1. When the cover 40 is mounted to the speaker system body 1, it is fitted to the speaker system body 1 such that the first protrusions 123 of the body engagement portions 120 and the third protrusions 53 of the cover engagement portions 50 are close to each other.

Figure 22:
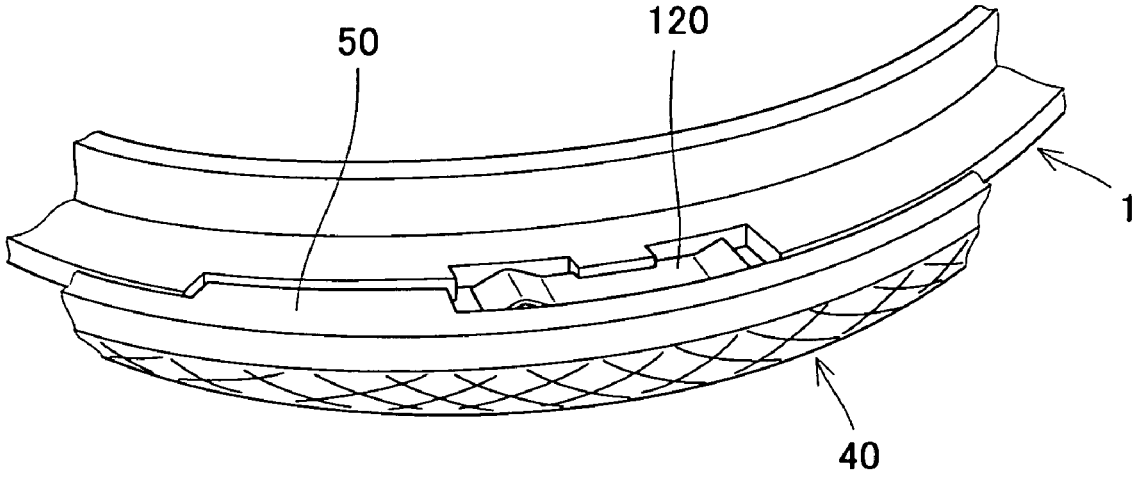
FIG. 22 is a perspective view of a body engagement portion and a cover engagement portion and its vicinity as viewed from a rear face side, with the cover fitted to the speaker system body.

FIG. 22 is a perspective view of the engagement portions (the body engagement portion 120 and the cover engagement portion 50) and its vicinity as viewed from the rear face side, with the cover 40 fitted to the speaker system body 1 (such that the first protrusions 123 are close to the third protrusions 53). In FIG. 22, the ceiling wall 30 is omitted. The cover 40 is rotated toward the back side in the circumferential direction from the state (state in FIG. 22) to thereby accomplish engagement between these engagement portions.

Figure 23:
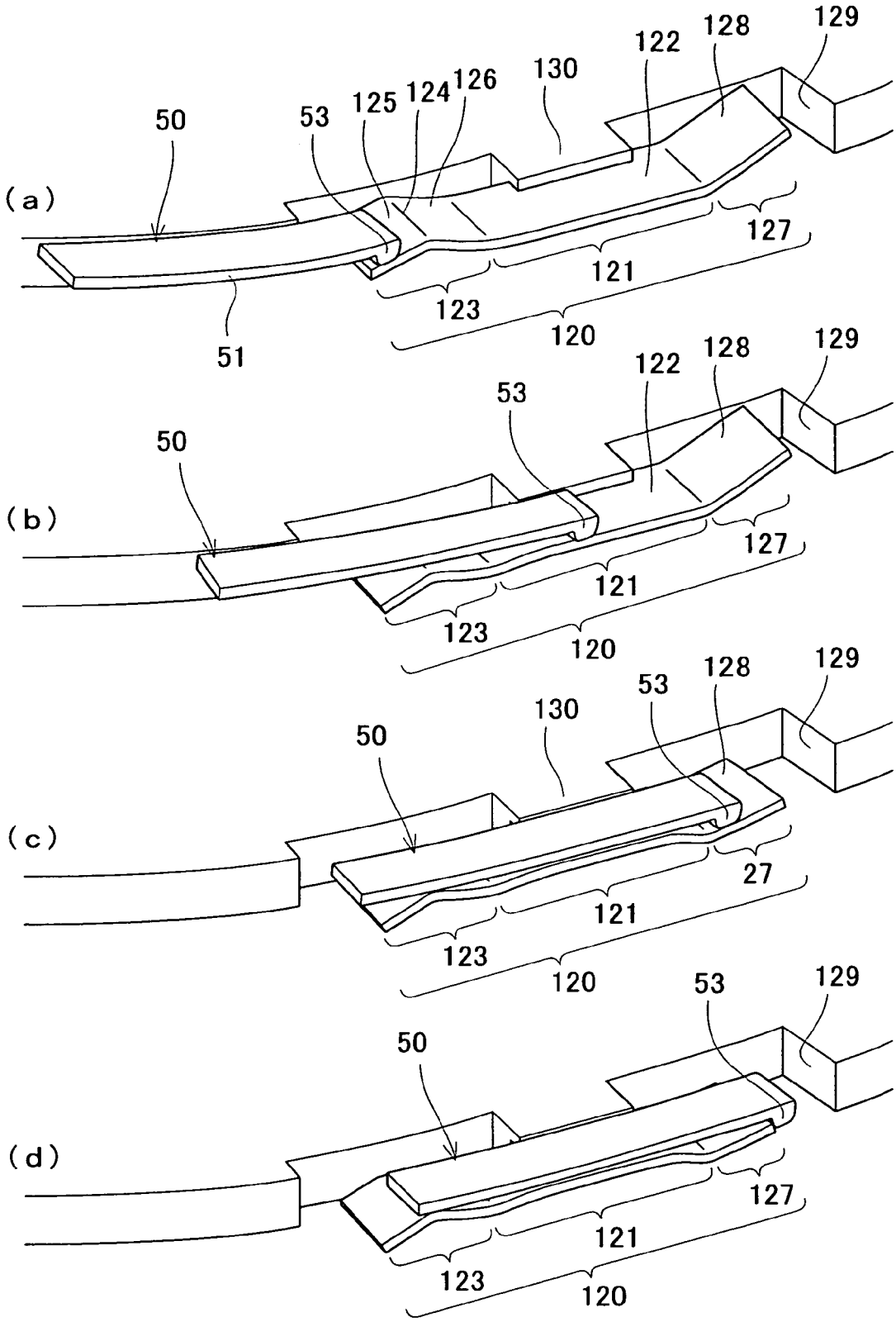
FIGS. 23(*a*) to 23(*d*) are perspective views showing a state in which the body engagement portion and the cover engagement portion are engaging with each other step by step.
Figure 24:
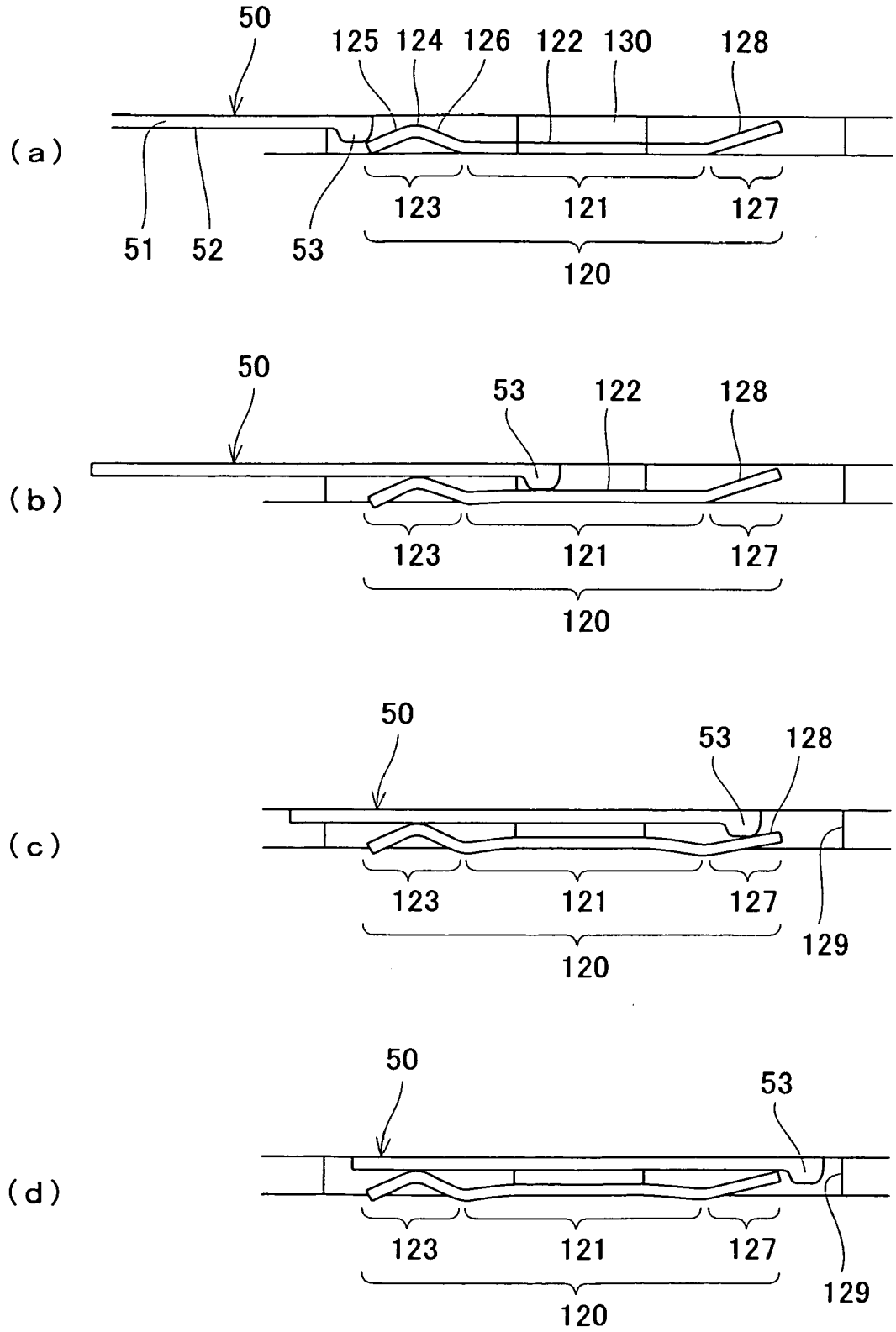
FIGS. 24(*a*) to 24(*d*) are side views showing a state in which the body engagement portion and the cover engagement portion are engaging with each other step by step.

FIGS. 23(*a*) to 23(*d*) are perspective views showing a state in which the body engagement portion 120 and the cover engagement portion 50 are engaging with each other step by step. FIGS. 24(*a*) to 24(*d*) are side views showing a state in which the body engagement portion 120 and the cover engagement portion 50 are engaging with each other step by step.

FIG. 23(*a*) and FIG. 24(*a*) show a state in which the engagement is going to start, in which state, the third protrusion 53 is moved to and positioned on the inclined face 125 of the first protrusion 123. The third protrusion 53 is guided along the inclined face 125 smoothly to the top portion 124. The horizontal portion 121 of the body engagement portion 120 is supported by the support portion 130. However, the support portion 130 does not extend to the first protrusion 123, and hence the first protrusion 123 is configured to deflect somewhat forward and rearward (in the vertical direction). When the third protrusion 53 is going to move over the first protrusion 123, the first protrusion 123 deflects forward (downward). This makes it easy that the third protrusion 53 moves over the first protrusion 123.

FIGS. 23(*b*) and FIG. 24(*b*) show a state in which the third protrusion 53 has moved over the first protrusion 123 and has reached the horizontal portion 121.

FIG. 23(*c*) and 24(*c*) show a state in which the third protrusion 53 is moved to and positioned on the inclined face 128 of the second protrusion 127. The third protrusion 53 is guided along the inclined face 128 smoothly to a tip end of the third protrusion 127. The support portion 130 adapted to support the horizontal portion 121 of the body engagement portion 120 does not extend to the second protrusion 127, and hence the second protrusion 127 is configured to deflect somewhat forward and rearward (in the vertical direction). When the third protrusion 53 is going to move over the second protrusion 127, the second protrusion 127 deflects forward (downward). This makes it easy that the third protrusion 53 moves over the second protrusion 127.

FIGS. 23(*d*) and 24(*d*) are views showing a state in which the third protrusion 53 has moved over the second protrusion 127. The cover engagement portion 50 is entirely positioned over the body engagement portion 120 in such a manner that the front face 52 of the horizontal portion 51 of the cover engagement portion 50 is positioned rearward (upward) relative to the rear face 122 of the horizontal portion 121 of the body engagement portion 120. When the cover engagement portion 50 is going to move further in the circumferential direction, it will contact the contact face 129, and thus, further movement of the cover engagement portion 50 is prevented. In this state, the third protrusion 53 and the second protrusion 127 are in engagement, and hence, engagement between them is not released unless a substantial rotational force is applied thereto. In other words, the third protrusion 53 does not move over the second protrusion 127 in a reverse direction without application of a substantial rotational force. As a result, the cover 40 is stably mounted to the speaker system body 1.

The state of FIGS. 23(*d*) and 24(*d*) is accomplishment of engagement. But, the body engagement portion 120 and the cover engagement portion 50 may be left in the state of FIGS. 23(*b*) and 24(*b*) without transitioning to the state 23(*d*) and 24(*d*).

This is because, when an operator is going to mount the cover 40 to the speaker system body 1, especially in a case where a rear end (upper end) of the cover 40 is in contact with the ceiling face 30*b*, it is necessary to apply a substantial rotational force to the cover 40 to cause the state of 23(*a*) and 24(*a*) to transition to the state of FIGS. 23(*b*) and 24(*b*), and the cover 40 is firmly secured in the state of FIGS. 23(*b*) and 24(*b*). For this reason, the operator may assume mistakenly that the engagement has been accomplished although the engagement portions (body engagement portion 120 and the cover engagement portion 50) are still in the state of FIGS. 23(*b*) and 24(*b*), and may finish operation in this state (state of FIGS. 23(*b*) and 24(*b*)).

If the third protrusion 53 moves over the first protrusion 123 in a reverse direction, then the cover 40 disengages and falls off from the cover 40, with the speaker system body 1 and the cover 40 left in this state (state of FIGS. 23(*b*) and 24(*b*)). This may occur if a substantial rotational force is applied to the cover 40, but such a large rotational force is not applied to the cover 40 in a normal use condition of the ceiling-embedded speaker system 100. When the speaker unit 2 is driven to thereby cause the speaker system body 1 or the cover 40 to vibrate, a rotational force large enough to cause the third protrusion 53 to move over the first protrusion 123 in the reverse direction will not be applied. So, the cover 40 does not disengage and fall off from the speaker system body 1 in the state of FIGS. 24(*b*) and 23(*b*) in the normal use condition of the ceiling-embedded speaker system 100. Therefore, it may be assumed that engagement between the body engagement portion 120 and the cover engagement portion 50 is accomplished in the state of FIGS. 23(*b*) and 24(*b*).

Thus far, one embodiment of the present invention has been described with reference to FIGS. 15 to 24. Subsequently, another embodiment will be described.

Figure 25:
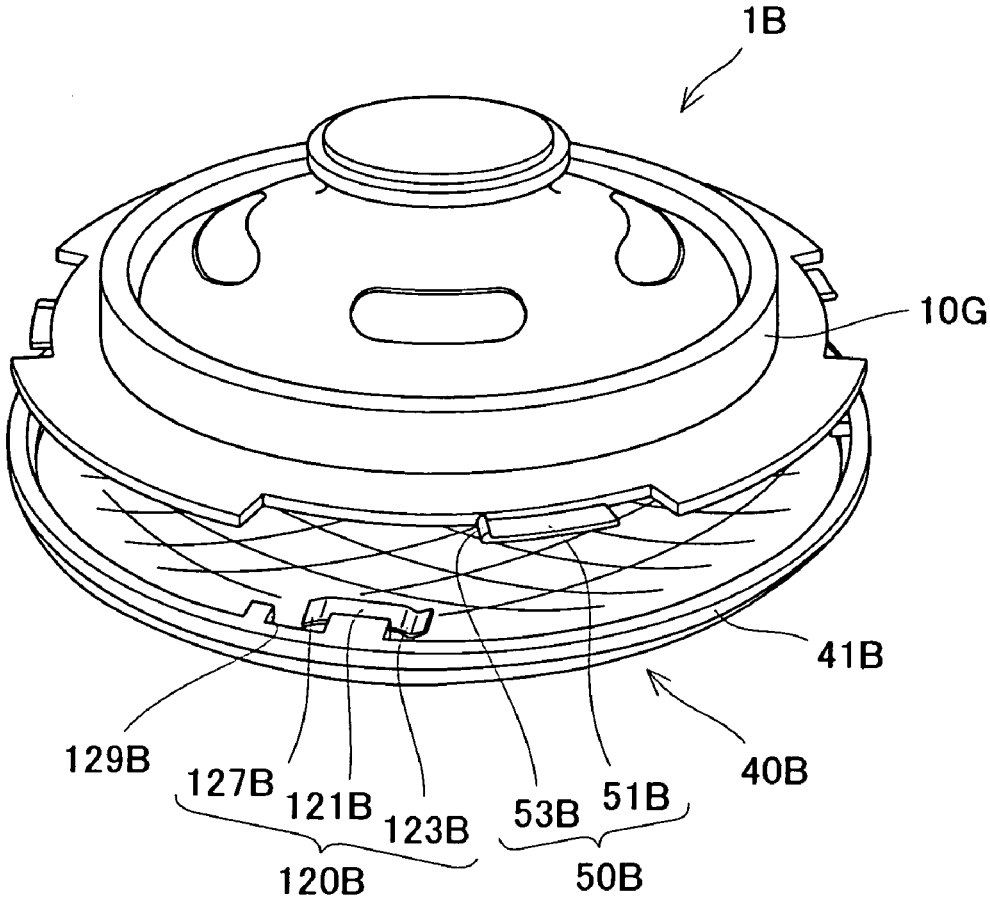
FIG. 25 is a perspective view of the speaker system body and the cover as viewed from the rear face side.
Figure 26:
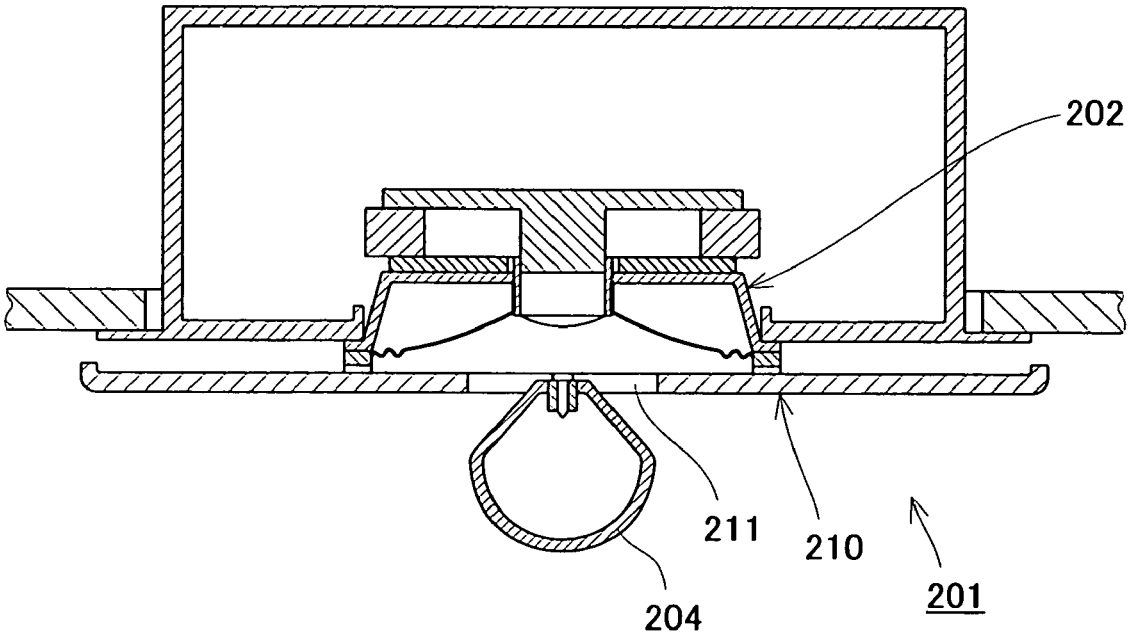
FIG. 26 is a longitudinal sectional view of a conventional wide dispersion speaker system.

FIG. 25 is a perspective view showing a speaker system body 1B and the cover 40B from the rear face side. Body engagement portions 50B are formed in a mounting element 10G of the speaker system body 1B. Cover engagement portions 120B are formed in a frame 41B of the cover 40B.

The cover engagement portion 120B includes a horizontal portion 121B, and a first protrusion 123B and a second protrusion 127B located at both ends thereof. The horizontal portion 121B extends in the circumferential direction, and its front face (lower face) is a horizontal face. The first protrusion 123B and the second protrusion 127B protrude forward (downward) further than a front face of the horizontal portion 121B.

The body engagement portion 50B has a horizontal portion 51B, and a third protrusion 53B at one end thereof. A rear face (upper face) of the horizontal portion 51B is a horizontal face. The third protrusion 53B protrudes rearward (upward) further than a rear face of the horizontal portion 51B.

As should be appreciated from comparison between FIGS. 25 and FIGS. 16 and 18, the cover engagement portion 120B of FIG. 25 has a structure identical to the structure of the body engagement portion 120 of FIG. 16, and the body engagement portion 50B of FIG. 25 has a structure identical to the structure of the cover engagement portion 50 of FIG. 18. That is, the cover engagement portion 120B of FIG. 25 is provided in the cover 40B to be structured such that the body engagement portion 120 of FIG. 16 is reversed forward and rearward (in the vertical direction) and in the circumferential direction, and the body engagement portion 50B of FIG. 25 is provided in the speaker system body 1B to be structured such that the cover engagement portion 50 of FIG. 18 is reversed forward and backward (in the vertical direction) and in the circumferential direction.

When the cover 40B of FIG. 25 is fitted to the speaker system body 1B from forward (from below) and is rotated, the cover engagement portion 120B is moved to and positioned on the body engagement portion 50B. When the first protrusion 123B and the second protrusion 127B have moved over the third protrusion 53B, engagement is accomplished.

When the cover 40B and the speaker system body 1B are left in the state in which the first protrusion 123B has moved over the third protrusion 53B and the second protrusion 127B has not moved over the third protrusion 53B, the cover 40B does not disengage from the speaker system body 1B in the normal use condition of the ceiling-embedded speaker system 100. This may occur if a rotational force large enough to cause the first protrusion 123B to move over the third protrusion 53B in a reverse direction is applied to the cover 40B, but such a large rotational force is not applied to the cover 40B in the normal use condition of the ceiling-embedded speaker system 100.

In FIG. 25, a face 129B is a contact face with which the third protrusion 53B makes contact when the engagement is accomplished.

Thus far, embodiments of the cover mounting structure for the instrument directly mounted to the flat portion of the present invention have been described with reference to FIGS. 15 to 25.

In the above-described embodiments, the speaker unit body is provided with the body engagement portions having the same structure and the cover is provided with the cover engagement portions having the same structure. But, these engagement portions are not intended to have the same structure. For example, a part of the plurality of body engagement portions provided in the speaker unit body may be the body engagement portions 120 of FIG. 16 and the remaining portions may be the body engagement portions 50B of FIG. 25. In this case, the cover may be provided with the cover engagement portions 50B of FIG. 18 and the cover engagement portions 120B of FIG. 25.

Figure 27:
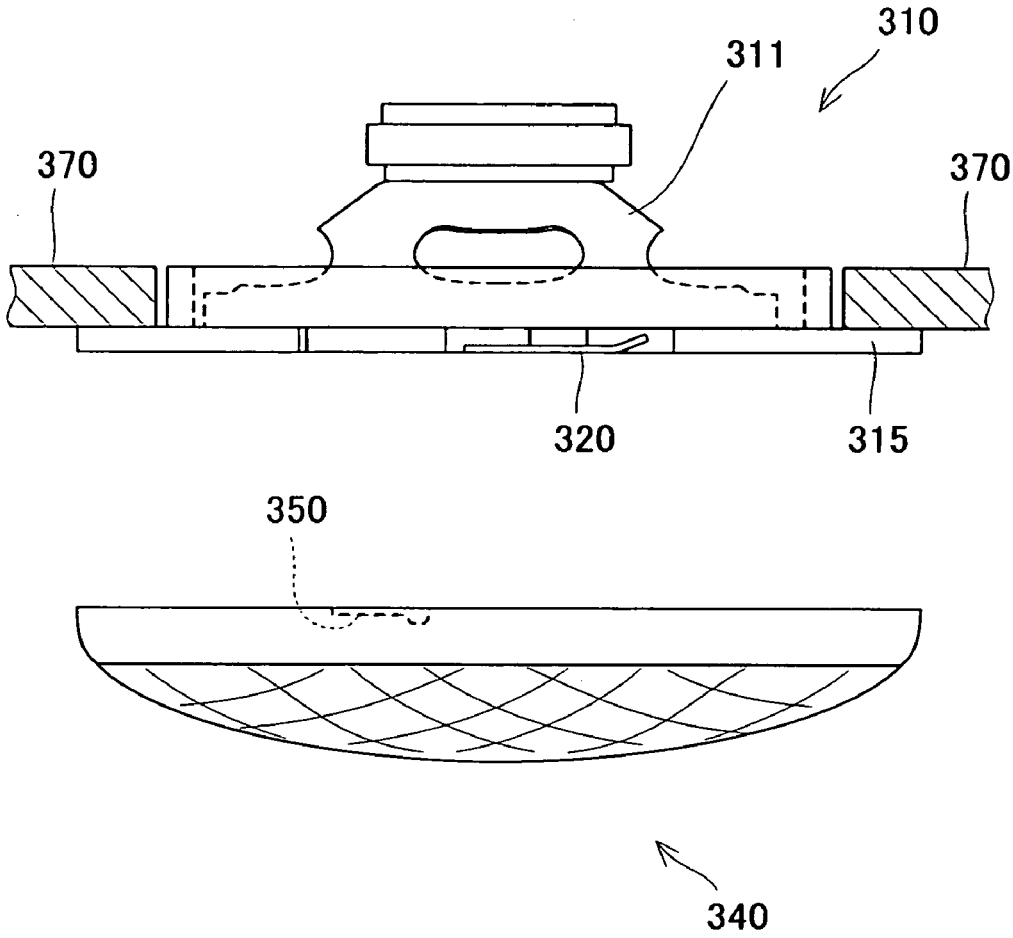
FIG. 27 is a side view of a conventional cover mounting structure, showing a speaker system body and a cover.
Figure 28:
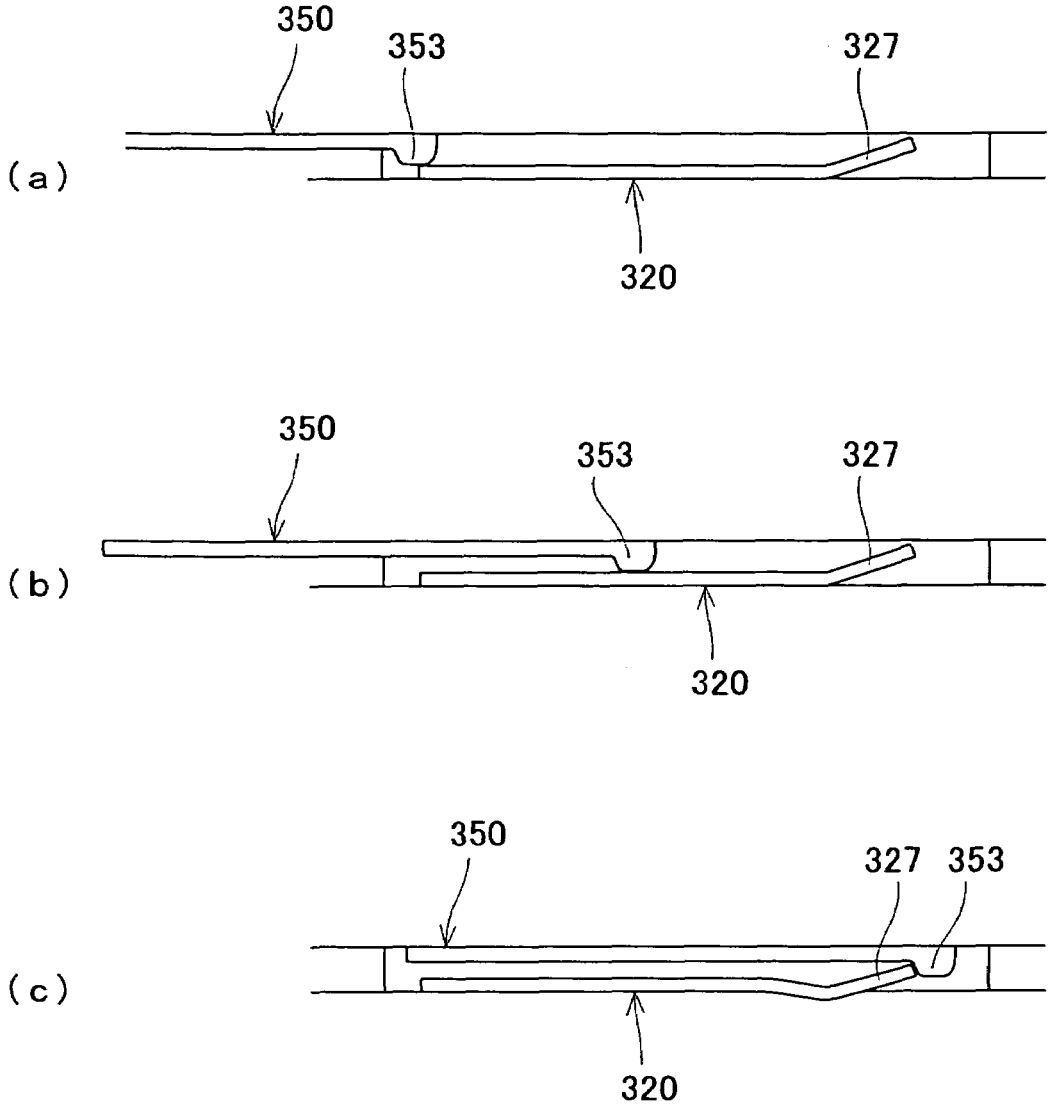
FIGS. 28(*a*) to 28(*c*) are side views showing a state in which the body engagement portion and the cover engagement portion are engaging with each other in the cover mounting structure of FIG. 27.

While the engagement portions of the cover mounting structure of the present invention are employed in the speaker unit body and the cover, a part of the plurality of engagement portions may employ the cover mounting structure of the present invention, and the remaining engagement portions may be the engagement portions (engagement portions of FIG. 27) of the conventional cover mounting structure.

While the first protrusions and the second protrusions are flexible forward and rearward (in the vertical direction), the third protrusions may alternatively be configured to be flexible in the same manner. In further alternative, the first protrusions, the second protrusions, and the third protrusions may be configured not to be flexible.

While the ceiling-embedded speaker system is illustrated as the instrument directly mounted to the flat portion to which the cover mounting structure of the present invention is applied, the instrument to which the present invention is applicable is not intended to be limited to this. For example, the cover mounting structure may be applicable to a fluorescent lamp directly mounted to the ceiling to enable a light-transmissible cover to be less likely to disengage from a mounted instrument body of an annular fluorescent lamp. Moreover, the mounting structure of the present invention may be applicable to instruments directly mounted to a side wall, a side face of large-sized equipment, a panel, etc, as well as to the ceiling face.

Thus far, the embodiments of the wide dispersion speaker system and the cover mounting structure for the instrument directly mounted to the flat portion have been described.

Numerous modifications and alternative embodiments of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

INDUSTRIAL APPLICABILITY

Since the wide dispersion speaker system of the present invention is capable of widening directivity, it is advantageous in fields of speaker systems.

In the cover mounting structure of the instrument directly mounted to the flat portion of the present invention, since the cover is less likely to disengage from the instrument body even in the state in which the cover directly mounted to the instrument body is left without accomplishment of engagement, it is advantageous in fields of the instrument directly mounted to the flat portion.

The invention claimed is:

1. A wide dispersion speaker system comprising:

a cone speaker unit; and a restricting element, wherein the cone speaker unit has a diaphragm, the restricting element is configured to cover the diaphragm from forward, the restricting element is provided with a center hole and a peripheral hole, the center hole is positioned forward relative to a center section of the diaphragm, the peripheral hole is positioned radially outward relative to the center hole, a sum of an area of the center hole and an area of the peripheral hole is smaller than an area of the diaphragm, the area of the center of the center hole is not less than 20% and not more than 50% of the area of the diaphragm, the area of the peripheral hole is not less than 1% and not more than 25% of the area of the center hole, the restricting element has an annular sound travel inhibiting portion positioned radially outward relative to the center hole and radially inward relative to the peripheral hole, and an outer end in a radial direction of the sound travel inhibiting portion is positioned at a substantially middle point between an outer end in the radial direction of the center hole and an outer end in the radial direction of the peripheral hole, or positioned radially outward relative to the substantially middle point.

2. The wide dispersion speaker system according to claim 1, wherein the outer end in the radial direction of the peripheral hole is positioned in the vicinity of a peripheral edge portion of the diaphragm in the radial direction.

3. The wide dispersion speaker system according to claim 2, wherein the peripheral hole is formed to surround an entire periphery of the center hole.

4. The wide dispersion speaker system according to claim 2, wherein the peripheral hole is one of a plurality of peripheral holes which are configured to be distributed to surround the entire periphery of the center hole.

5. The wide dispersion speaker system according to claim 2, wherein the peripheral hole is formed to surround the center hole in an angular range of not less than 180 degrees around a center axis of the cone speaker unit.

6. The wide dispersion speaker system according to claim 2, wherein the peripheral hole is one of a plurality of peripheral holes which are configured to be distributed to surround the center hole in an angular range of not less than 180 degrees around a center axis of the cone speaker unit.

7. The wide dispersion speaker system according to claim 1, wherein the peripheral hole is formed to surround an entire periphery of the center hole.

8. The wide dispersion speaker system according to claim 1, wherein the peripheral hole is one of a plurality of peripheral holes which are configured to be distributed to surround the entire periphery of the center hole.

9. The wide dispersion speaker system according to claim 8, wherein the peripheral hole is a slit hole extending in the radial direction.

10. The wide dispersion speaker system according to claim 9, wherein the peripheral hole has a slit width smaller than a depth of the peripheral hole.

11. The wide dispersion speaker system according to claim 1, wherein the peripheral hole is formed to surround the center hole in an angular range of not less than 180 degrees around a center axis of the cone speaker unit.

12. The wide dispersion speaker system according to claim 11, wherein the peripheral hole is configured not to be formed in an angular range of not less than 45 degrees around the center axis of the cone speaker unit.

13. The wide dispersion speaker system according to claim 1, wherein the peripheral hole is one of a plurality of peripheral holes which are configured to be distributed to surround the center hole in an angular range of not less than 180 degrees around a center axis of the cone speaker unit.

14. The wide dispersion speaker system according to claim 13, wherein the peripheral hole is configured not to be formed in an angular range of not less than 45 degrees around the center axis of the cone speaker unit.

15. The wide dispersion speaker system according to claim 13, wherein the peripheral hole is a slit hole extending in the radial direction.

16. The wide dispersion speaker system according to claim 1, wherein the peripheral hole is disposed non-symmetrically with respect to a center axis of the cone speaker unit.

17. The wide dispersion speaker system according to claim 1, wherein a diffuser is mounted forward relative to the center hole.

18. A wide dispersion speaker system comprising:

a cone speaker unit having a central axis and including a diaphragm having a conical portion, the diaphragm having an area; and a restricting element substantially covering a forward portion of the diaphragm;

a center hole formed in the restricting element and positioned over a center section of the diaphragm and having an outer boundary and an area;

a peripheral hole positioned radially outward relative to the center hole and having an area, the area of the peripheral hole less than the area of the eenter hole, the peripheral hole having an outer boundary;

the area of the center hole plus the area of the peripheral hole smaller than the area of the diaphragm;

the area of the center hole less than the area of the diaphragm;

the peripheral hole and the center hole cooperating to form an annular sound travel inhibiting portion surrounding the center hole and having a portion positioned between the center hole and the peripheral hole; and the outer boundary of the sound travel inhibiting portion positioned at least halfway between the central axis and the outer boundary of the peripheral hole.

19. The system of claim 18, wherein the area of the peripheral hole is between 1% and 25% of the area of the center hole.

20. The system of claim 19, wherein the area of the center hole is between 20% and 50% of the area of the diaphragm.

21. The system of claim 19, wherein the peripheral hole surrounds at least 50% of the center hole.

22. The system of claim 19, wherein the peripheral hole comprises only a single arcuate slot.

23. The system of claim 22, wherein the peripheral hole extends continuously between 180° and 315° about the center hole.

* * * * *